US006304164B1

(12) United States Patent
Ohno et al.

(10) Patent No.: US 6,304,164 B1
(45) Date of Patent: Oct. 16, 2001

(54) MULTILAYER ELECTRONIC COMPONENT AND MANUFACTURING METHOD THEREFOR

(75) Inventors: Syunichi Ohno; Masahiko Yamagishi, both of Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 09/240,699

(22) Filed: Feb. 2, 1999

(30) Foreign Application Priority Data

Feb. 2, 1998 (JP) ..... 10-020699
Apr. 7, 1998 (JP) ..... 10-094851

(51) Int. Cl.[7] ..... H01F 5/00

(52) U.S. Cl. ..... 336/200; 336/83; 336/223; 336/232; 29/602.1

(58) Field of Search ..... 336/83, 200, 223, 336/232; 29/602.1, 606

(56) References Cited

U.S. PATENT DOCUMENTS

| | | | | |
|---|---|---|---|---|
| 3,812,442 | | 5/1974 | Muckelroy . | |
| 5,578,981 | * | 11/1996 | Tokuda | 336/171 |
| 5,610,565 | * | 3/1997 | Maeda et al. | 333/185 |
| 5,985,414 | * | 11/1999 | Fukuda et al. | 428/192 |
| 6,114,936 | * | 9/2000 | Yamamoto et al. | 336/192 |
| 6,147,573 | * | 11/2000 | Kumagai et al. | 333/185 |

* cited by examiner

*Primary Examiner*—Anh Mai
(74) *Attorney, Agent, or Firm*—Lowe Hauptman Gilman & Berner, LLP

(57) ABSTRACT

A multilayer electronic component (100) incorporating a laminate (101) in which a coil (102) which is an electronic element has been embedded; terminal electrodes (103) formed at two ends of said laminate (101) in a direction of lamination; and a lead electrode (104) for drawing the coil (102) to the end surface of the laminate (101) and establishing the connection with the terminal electrodes (103), wherein the diameters of via holes for constituting the lead electrode (104) are enlarged from the coil (102) to the terminal electrodes (103).

11 Claims, 19 Drawing Sheets

MULTILAYER ELECTRONIC COMPONENT AND MANUFACTURING METHOD THEREFOR

BACKGROUND OF THE INVENTION

1. Field of the Invention

The present invention relates to a multilayer electronic component, such as a laminated inductor, and a manufacturing method therefor.

2. Description of the Related Art

A conventional multilayer electronic component has a known structure in which a terminal electrode is formed at each end of a rectangular parallelepiped laminate. The multilayer electronic component is manufactured as follows: initially, ceramic green sheets are laminated so that a laminate of the sheets is formed. Then, the laminate of the sheets is cut to have a size of each of unit components. Then, each of the cut laminates of the sheets are baked and polished so that a laminate is obtained. Finally, a terminal electrode is formed at each end of the laminate so that a multilayer electronic component is manufactured.

A direction in which the green sheets are laminated is a direction perpendicular to a direction in which the two terminal electrode are connected to each other. However, the directions of internal electrodes of a multilayer electronic component of the foregoing type cannot be made constant, causing the characteristics of the multilayer electronic component to be instable. The foregoing fact becomes conspicuous especially for a laminated inductor which is an example of the multilayer electronic component.

Therefore, multilayer electronic components have appeared in recent years, each of which incorporates green sheets laminated in a direction in parallel with a direction of the connection between the terminal electrodes. A laminated inductor which is an example of the multilayer electronic component of the foregoing type will now be described. The laminated inductor is formed by laminating a green sheet having an internal conductor to be formed into a coil, and a green sheet having lead electrodes for establishing the connection between the internal conductor and a terminal electrode. Each green sheet has a via hole filled with a conductor for establishing the connection. Thus, the green sheets are electrically conducted to each other through the via holes. In the foregoing laminated inductor, the direction of the magnetic flux is in parallel to a direction in which the terminal electrodes are connected to each other. That is, the terminal electrodes are formed at two ends of the laminate in the direction of lamination. Therefore, the direction of the magnetic flux after a mounting operation is always in parallel with the surface of mounting. As a result, stable characteristics can be obtained.

However, the lead conductor of the laminated inductor cannot easily be formed. That is, the laminated inductor has the lead conductor which extends substantially straight from the internal conductor to the terminal electrode. Therefore, when the green sheets are laminated, a conductor for establishing the connection is undesirably deviated by a stress. Thus, the electrical conduction between the internal conductor and the terminal electrode is sometimes disconnected. The laminated inductor is formed such that the direction in which the terminal electrodes are connected to each other and that of the magnetic flux are in parallel with each other. Therefore, a larger number of green sheets must be laminated as compared with the conventional multilayer electronic component. Therefore, long time is required to complete the laminating process, thus causing the productivity to deteriorate. What is worse, the laminated inductor sometimes encounters a fact that a required shape cannot always be obtained because burrs and/or breakage occur, in particular, at two ends of the laminated inductor when the laminate is polished. As described above, the foregoing laminated inductor has been suffered from unsatisfactory manufacturing yield.

SUMMARY OF THE INVENTION

An object of the present invention is to provide a multilayer electronic component and a manufacturing method therefor, which is capable of preventing defective connection of a lead conductor thereof and improving the manufacturing yield.

To achieve the above-mentioned object, according to one aspect of the present invention, there is provided a multilayer electronic component, comprising: a laminate with an electronic element embedded therein; and terminal electrodes formed at two ends of the laminate in laminating direction and connected to the electronic element, wherein said laminate incorporates lead electrodes for connecting said electronic element to said terminal electrodes, first insulating sheets each having an element conductor which constitutes said electronic element are laminated such that said element conductors are connected to one another through first via holes, a plurality of second insulating sheets each having a connecting conductor which constitutes said lead electrode are laminated such that said connecting conductors are connected to one another through second via holes, and a contact area of said connecting conductors between at least a portion of said second insulating sheets is made to be larger than a contact area of said element conductors between said first insulating sheets.

According to the present invention, when the second insulating sheets are laminated and pressed, a greater allowance is permitted for the position deviation between the second via holes in the upper and lower layers. As a result, the connection between the connecting conductors between the second insulating sheets can reliably be established.

According to another aspect of the present invention, there is provided a multilayer electronic component, comprising: a laminate with an electronic element embedded therein; and terminal electrodes formed at two ends of the laminate in laminating direction and connected to the electronic element, wherein said laminate incorporates lead electrodes for connecting said electronic element to said terminal electrodes, first insulating sheets each having an element conductor which constitutes said an electronic element are laminated such that said element conductors are connected to one another through first via holes, a plurality of second insulating sheets each having a connecting conductor which constitutes said lead electrode are laminated such that said connecting conductors are connected to one another through second via holes, said second via holes are formed on two or more different straight lines extending in a direction of lamination, and said connecting conductors are alternately connected through said second via holes formed on the two or more straight lines.

According to the present invention, when the second insulating sheets have been laminated, the positions of step portions formed by the connecting conductors are not concentrated on one straight line extending in the direction of lamination. Thus, stress produced by the stepped portion is dispersed and thus deviation of the positions of the second via holes can be reduced. Therefore, the connection of the connecting conductors between the second insulating sheets can reliably be established.

According to another aspect of the present invention, there is provided a multilayer electronic component, comprising: a laminate with an electronic element embedded therein; and terminal electrodes formed at two ends of the laminate in laminating direction and connected to the electronic element, wherein said laminate incorporates lead electrodes for connecting said electronic element to said terminal electrodes, first insulating sheets each having an element conductor which constitutes said an electronic element are laminated such that said element conductors are connected to one another through first via holes, a plurality of second insulating sheets each having a connecting conductor which constitutes said lead electrode are laminated such that said connecting conductors are connected to one another through second via holes, and said connecting conductor formed on said second insulating sheet is formed to project over said second via hole formed in said second insulating sheet.

According to the present invention, if the positions of the second via holes are deviated owning to the internal stress when the second insulating sheets have been laminated and pressed, the connecting conductors formed on the second insulating sheets enable the connecting conductors between the second insulating sheets to reliably be connected to each other.

According to another aspect of the present invention, there is provided a method of manufacturing a multilayer electronic component which incorporates terminal electrodes formed on a laminate with an electronic element embedded therein and connected to said electronic element, comprising the steps of: forming a plurality of partial sheet laminates by laminating insulating sheets each having a conductor; forming a laminate of sheets by laminating the plurality of said partial sheet laminates;forming substantially a rectangular parallelepiped laminate after said laminate of sheets has been cut; and forming said terminal electrodes for said laminate.

According to the present invention, each of the partial laminates of sheets can be manufactured by a most efficient manufacturing method optimum for each partial laminate of the sheets. Therefore, the efficiency of manufacturing multilayer electronic components can be improved. When two or more different types of multilayer electronic components having common laminated portions are manufactured, the common portions are collectively manufactured as the partial laminates of sheets. Thus, each multilayer electronic component can efficiently be manufactured. Moreover, the partial laminates of sheets having different attributes can be manufactured. For example, the thicknesses and hardness of the insulating sheets are made to be different from those of the other partial laminates of sheets, then, laminates of sheets are manufactured from the partial laminates of sheets.

Other objects, features and advantages of the invention will be evident from the following detailed description of the preferred embodiments.

DESCRIPTION OF THE PREFERRED EMBODIMENTS

Figure 1:
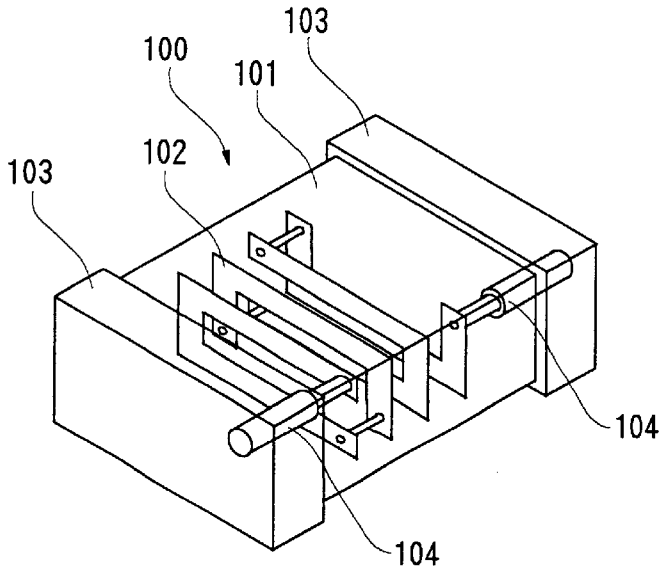
FIG. 1 is a schematic perspective view showing a laminated inductor according to a first embodiment.
Figure 2:
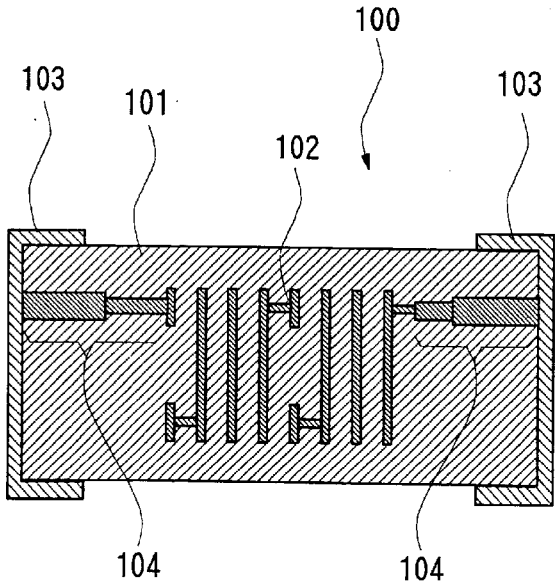
FIG. 2 is a side cross sectional view showing the laminated inductor according to the first embodiment.
Figure 3:
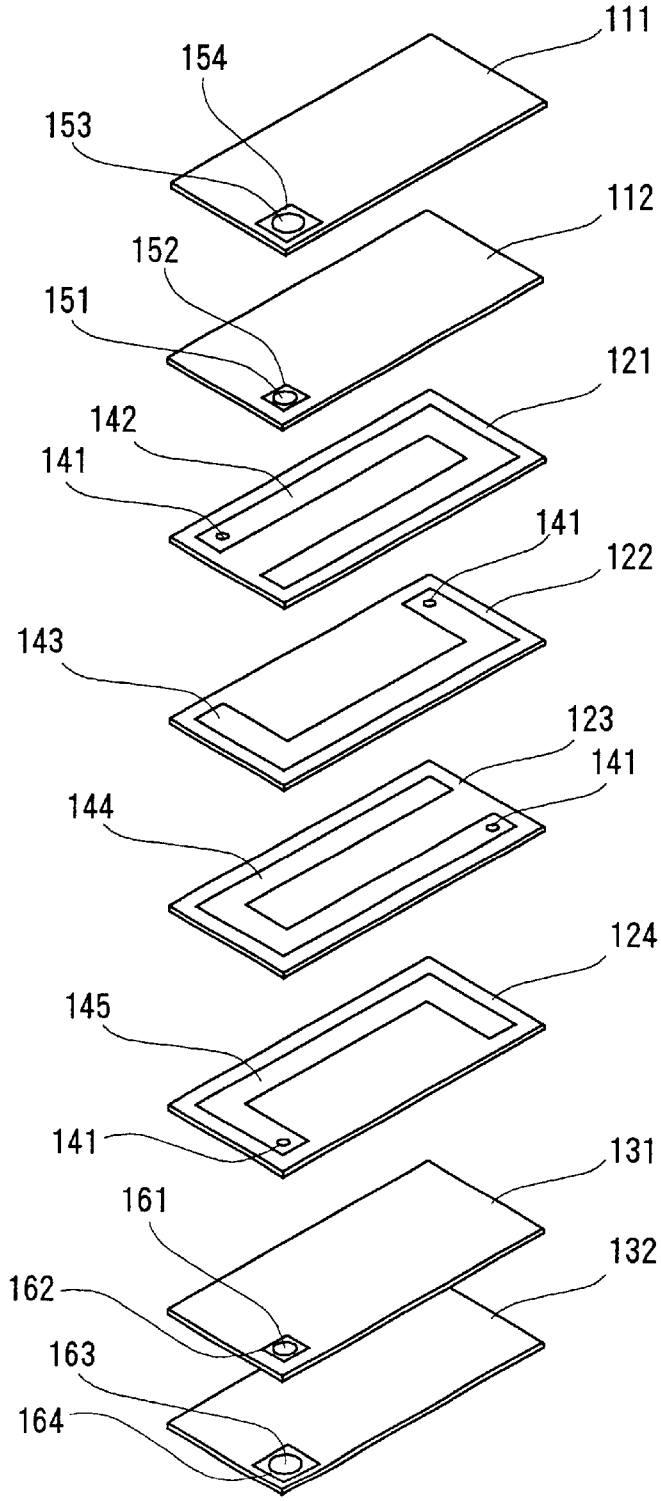
FIG. 3 is an exploded perspective view showing a laminate structure of a laminate according to the first embodiment.

A multilayer electronic component according to a first embodiment of the present invention will now be described with reference to FIGS. 1 to 3. A laminated inductor will now be described as an example of the multilayer electronic component. FIG. 1 is a schematic perspective view showing the laminated inductor, FIG. 2 is a side cross sectional view showing the laminated inductor and FIG. 3 is an exploded perspective view showing a laminate structure of a laminate.

The laminated inductor 100 incorporates a substantially rectangular parallelepiped laminate 101, a coil 102 which is an electronic element embedded in the laminate 101 and a pair of terminal electrodes 103 formed at the lengthwise directional ends of the laminate 101. In the laminate 101, lead electrodes 104 are embedded which establish the connection between the coil 102 and the terminal electrodes to each other.

The laminate 101 is made of a magnetic or non-magnetic insulating material. The laminate 101 is formed by laminating insulating sheets in a direction in which the two terminal electrodes 103 are connected to each other. That is, as shown in FIG. 3, the laminate 101 is formed by laminating upper-layer sheets 111 and 112, the sheets being rectangular insulating sheets each having a predetermined thickness, coil-layer sheets 121 to 124 and lower-layer sheets 131 and 132. Hereinafter the direction of lamination of the sheets is explained as a vertical direction as shown in FIG. 3.

The coil 102 is formed by laminating rectangular coil-layer sheets 121 to 124. U-shaped Element conductors 142 to 145 each having a via hole 141 in an end portion thereof are formed on the coil-layer sheets 121 to 124. A conductor is filled in each of the via holes 141. The diameter of each of the via holes 141 is 50 $\mu$m similar to that of a conventional multilayer electronic component.

When the coil-layer sheets 121 to 124 are laminated, ends of the upper- and lower-layer element conductors 142 to 145 and other ends of the same are connected to one another by the via holes 141. As a result, a spiral coil 102 consisting of the element conductors 142 to 145 is formed.

Hereinafter the via hole filled with the conductor is simply called a "via hole". Description "connected to the via hole" means "connected to the conductor filled in the via hole" and "connected through the via hole" means "connected through the conductor filled in the via hole".

The lead electrodes 104 are formed as follows: one or more upper-layer sheets 112 are laminated on the coil-layer sheet 121. Note that FIG. 3 shows a single layer structure. The sheet 112 has a via hole 151 formed therein. On the upper-layer sheet 112, a connecting conductor 152 is formed in and around the via hole 151. The via hole 151 establishes the connection between the connecting conductor 152 and the element conductor 142.

One or more upper-layer sheets 111 are laminated on the upper-layer sheet 112. A single layer structure is shown in FIG. 3. The upper-layer sheet 111 has a via hole 153. On the upper-layer sheet 111, a connecting conductor 154 is formed in and around the via hole 153. The connecting conductor 154 is connected to the connecting conductor 152 through the via hole 153. The connecting conductor 154 of the upper-layer sheet 111 which is the uppermost sheet is connected to the terminal electrodes 103.

Moreover, one or more lower-layer sheets 131 are laminated below the coil-layer sheet 124. FIG. 3 shows a single layer structure. The sheet 131 has a via hole 161. A connecting conductor 162 is formed on the upper surface of the sheet 131 in and around the via hole 161. The connecting conductor 162 is connected to the element conductor 145 through the via hole 141 formed in the upper coil-layer sheet 124.

Moreover, one or more lower-layer sheets 132 are laminated below the lower-layer sheet 131. Note that FIG. 3 shows a single layer structure. A via hole 163 is formed in the lowerlayer sheet 132. On the sheet 132, a connecting conductor 164 is formed in and around the via hole 163. The connecting conductor 164 is connected to the connecting conductor 162 through a via hole 161 formed in the lower-layer sheet 131. The connecting conductor 164 of the lower-layer sheet 132 which is the lowermost sheet is connected to the terminal electrodes 103 through the via hole 163.

The thus-formed plural connecting conductors 152, 154, 162 and 164 constitute the lead electrodes 104.

The diameter of each of the via holes 151, 153, 161 and 163 is made to be larger than the diameter of each of the via holes 141 for connecting the element conductors 142 to 144 to one another, preferably twice or larger. The diameter of each of the via holes 153 and 163 is made to be larger than the diameter of each of the via holes 151 and 161, preferably 1.5 times or larger. In this embodiment, the diameter of each of the via holes 151 and 161 is 100 $\mu$m. The diameter of each of the via holes 153 and 163 is 150 $\mu$m.

A method of manufacturing the laminated inductor 100 will now be described. Initially, the sheets 111, 112, 121 to 124, 131 and 132 are prepared.

The coil-layer sheets 121 to 124 of the portion in which the coil 102 will be formed are formed by forming the via holes 141 at predetermined positions of green sheets mainly composed of a ceramic material made of BaO or $TiO_2$. Then, the four types of the U-shaped element conductors 142 to 145 are formed such that the ends of the element conductors 142 to 145 overlap the via holes 141. As known, the shape of each of the element conductors 142 to 145 may be a non-annular shape, such as an L-shape or the like as well as the U-shape.

The upper-layer sheets 111 and 112 and the lower-layer sheets 131 and 132 are formed by forming via holes 151, 153, 161 and 163 at predetermined positions of the green sheets. Then, rectangular connecting conductors 152, 154, 162 and 164 are formed to overlap the via holes 151, 153, 161 and 163.

The via holes 141, 151 and 161 are formed by irradiation with laser beams when the green sheets are supported by films. When the green sheets are not supported by the films, the foregoing via holes 141, 151 and 161 are formed by punching.

The prepared sheets are laminated in the above-mentioned order while the films are being separated when films are provided for the sheets. Then, the sheets are pressed at a pressure of about 500 kg /$cm^2$ so that a laminate of the sheets are formed. The numbers of the upper-layer sheets 111 and 112 and the lower-layer sheets 131 and 132 correspond to the length of the lead electrodes 104. The numbers of the coil-layer sheets 121 to 124 correspond to the length of the coil 102.

Then, the laminate of the sheets are burnt at a temperature of about 900° C. Conductor paste is, by dipping or the like, applied to the two ends of the laminate 101 obtained by the burning operation in the direction of lamination. The conductor paste is burnt so that the terminal electrodes 103 are formed. Then, the terminal electrodes 103 are plated with Sn—Pb or the like, if necessary. Thus, the laminated inductor 100 is obtained.

The laminated inductor 100 has the structure that the diameter of each of the via holes 151, 153, 161 and 163, which constitute the lead electrodes 104, is made to be larger than the diameter of the via holes 141 which constitutes the coil 102.

Therefore, when the green sheets are laminated and pressed in manufacturing process, a great allowance of deviation of the positions of the via holes in the upper and lower layers is permitted as compared with the conventional technique. As a result, the connection between the connecting conductors can further reliably be established.

Moreover, the diameters of the via holes 151, 153, 161 and 163 which constitute the lead electrodes 104 are made such that those of the via holes adjacent to the terminal electrodes 103 are made to be lager than those of the via holes adjacent to the coil 102. Therefore, when the green sheets are laminated and pressed in manufacturing process, the positions of the stepped portions formed by the connecting conductors 152, 154, 162 and 164 do not concentrate on one straight line extending in the direction of lamination.

Therefore, internal stress produced in laminating process can be dispersed and thus deviation of the positions of the via holes in the upper and lower layers can be reduced.

As a result, the electrical connections among the connecting conductors 152, 154, 162 and 164 can reliably be established. Thus, defective connection of the lead electrodes 104 can considerably be prevented. That is, the manufacturing yield can be improved.

The above-mentioned structure enables the exposed area of the lead electrodes 104 on the end surface of the laminate 101 to be enlarged. Therefore, the connection between the lead electrodes 104 and the terminal electrodes 103 can easily be improved.

Figure 4:
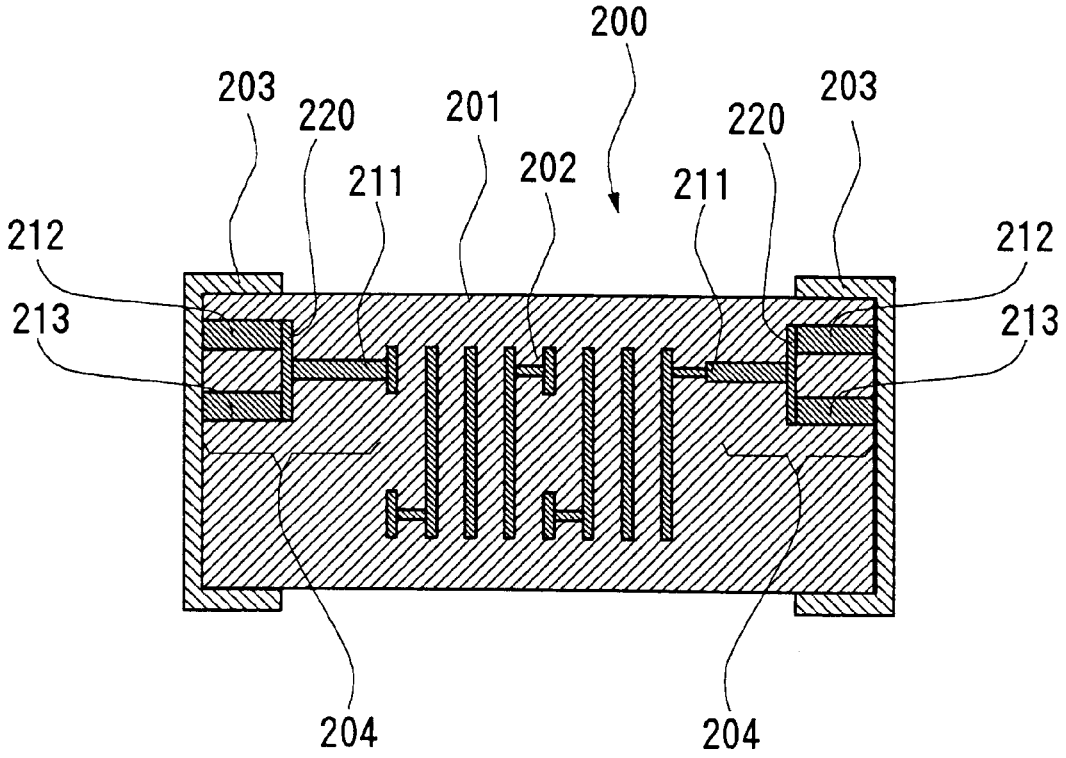
FIG. 4 is a side cross sectional view showing a laminated inductor according to a second embodiment.
Figure 5:
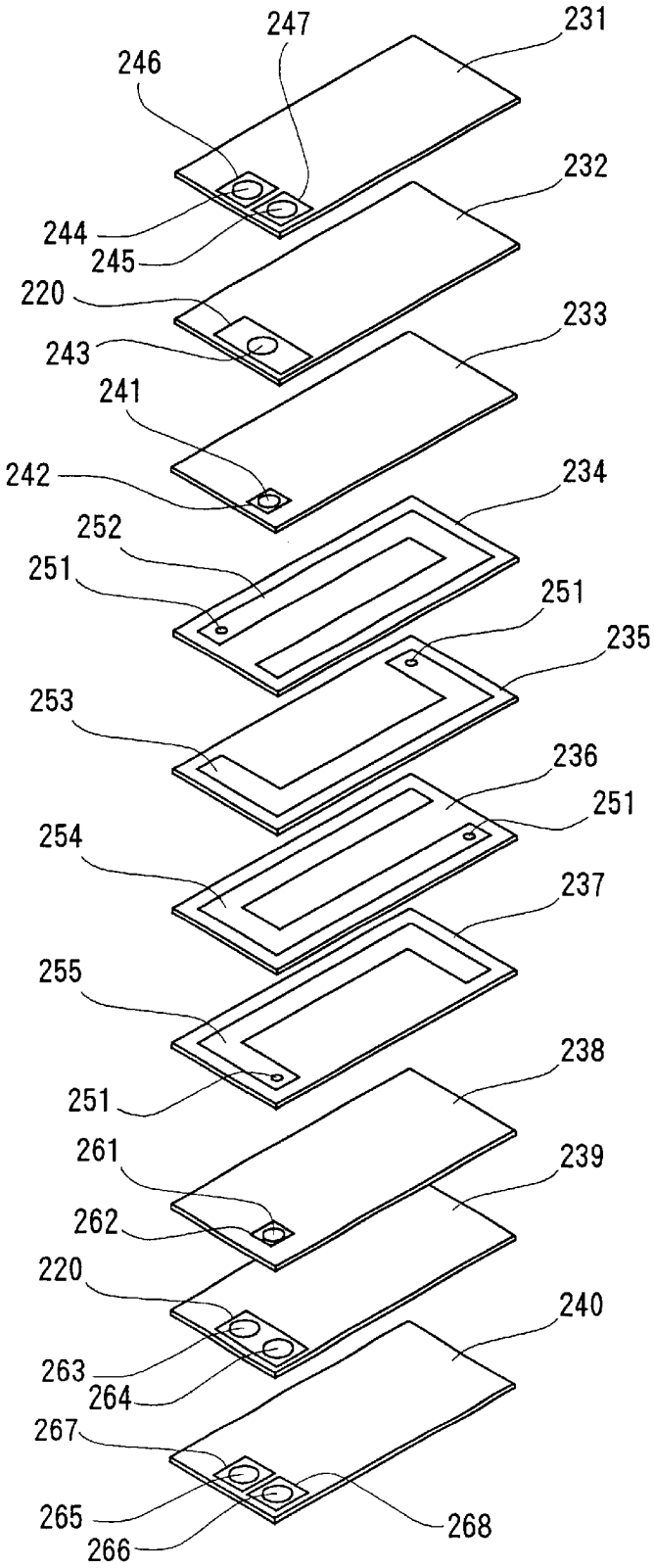
FIG. 5 is an exploded perspective view showing a laminate structure of a laminate according to the second embodiment.

A multilayer electronic component according to a second embodiment will now be described with reference to FIGS. 4 and 5. A laminated inductor will now be described as an example of the multilayer electronic component. FIG. 4 is a side cross sectional view showing the laminated inductor. FIG. 5 is an exploded perspective view showing a laminate structure of a laminate.

Similarly to the laminated inductor 100, the laminated inductor 200 incorporates terminal electrodes 203 formed at two ends of a laminate 201 in which a coil 202 is embedded. A direction of lamination of the laminate 201 is in parallel with a direction in which the terminal electrodes 203 are connected to each other.

The laminated inductor 200 is different from the laminated inductor 100 in that the lead electrode 204 is branched into two directions at the coil 202 toward the terminal electrode 203.

The laminated inductor 200 incorporates lead electrodes 204 each of which is composed of a first branch 211, a second branch 212 and a third branch 213, as shown in FIG. 4. The second branch 212 and the third branch 213 are in parallel with each other.

An end of the first branch 211 is connected to an end of the coil 102. Another end of the first branch 211 is connected to an end of the second branch 212 and an end of the third branch 213 through a connecting conductor 220. Other ends of the second branch 212 and the third branch 213 are exposed on the end surface of the laminate 201 so as to be connected to the terminal electrode 203.

Similarly to the first embodiment, the lead electrodes 204 can easily be obtained by providing via holes and connecting conductors for the upper-layer sheets and the lower-layer sheets.

As shown in FIG. 5, one or more upper-layer sheets 233 are laminated on the coil-layer sheet 234. FIG. 5 shows a single layer structure. The sheet 233 has a via hole 241 formed therein. Moreover, a connecting conductor 242 arranged to be connected to the via hole 241 is provided for the upper-layer sheet 233. The via hole 241 establishes the connection between ends of the connecting conductor 242 and the element conductor 252.

One upper-layer sheets 232 is laminated on the upper-layer sheet 233. The upper-layer sheets 232 has a via hole 243 formed therein. The connecting conductor 220 arranged to be connected to the via hole 243 is form ed on the upper-layer sheets 232. The connecting conductor 220 has a width larger than that of the connecting conductor 242. The via hole 243 establishes the connection between the connecting conductor 242 and the connecting conductor 220.

One or more upper-layer sheets 231 are laminated on the upper-layer sheets 232. FIG. 5 shows a single layer structure. Two via holes 244 and 245 are provided for the upper-layer sheet 231 at a predetermined interval. Moreover, connecting conductors 246 and 247 arranged to be connected to the via holes 244 and 245 are provided for the upper-layer sheet 231. The connecting conductors 246 and 247 are connected to the connecting conductor 220 through the via holes 244 and 245.

Connecting conductors 246 and 247 of the upper-layer sheet 231 which is the uppermost layer are connected to the terminal electrode 203 respectively.

One or more lower-layer sheets 238 are laminated below the coil-layer sheet 237. FIG. 5 shows a single layer structure. A via hole 261 is formed in the lower-layer sheet 238. The lower-layer sheet 238 has a connecting conductor 262 arranged to be connected to the via hole 261. The connecting conductor 262 is connected to an end of the element conductor 255 through a via hole 251 formed in the coil-layer sheet 237.

One lower-layer sheet 239 is laminated below the lower-layer sheet 238. Via holes 263 and 264 are provided for the lower-layer sheet 239 at a predetermined interval. The lower-layer sheet 239 has the connecting conductor 220 arranged to be connected to the via holes 263 ad 264. The connecting conductor 220 has a width larger than that of the connecting conductor 262. The connecting conductor 220 is connected to the connecting conductor 262 through the via hole 261 formed in the lower-layer sheet 238.

One or more lower-layer sheets 240 are laminated below the lower-layer sheet 239. FIG. 5 shows a single layer structure. Two via holes 265 and 266 are provided for the lower-layer sheet 240 at a predetermined interval. Connecting conductors 267 and 268 arranged to be connected to the via holes 265 and 266 are provided for the lower-layer sheet 240. The connecting conductors 267 and 268 are connected to the connecting conductor 220 through the via holes 263 ad 264 formed in the lower-layer sheet 239. Connecting conductors 267 and 268 of the lower-layer sheet 240 which is the lowermost layer are connected to the terminal electrodes 203 through the corresponding via holes 265 and 266.

As well as the first embodiment, the coil 202 is formed by laminating the coil-layer sheets 234 to 237 having the corresponding element conductors 252 to 255. That is, the via holes 251 formed at the end portions of the element conductors 252 to 255 establish the connection among the element conductors 252 to 255 so that the coil 202 is formed.

The diameter of each of the via holes 241, 243, 244, 245, 261, 263, 264, 265 and 266 is determined as well as the first embodiment. That is, the diameter of each via hole is twice or more times as large as the diameter of the via hole 251. The diameter of each of the via holes 243, 244, 245, 263, 264, 265 and 266 is 1.5 times or larger than the diameter of each of the via holes 241 and 261.

The diameters of the via holes which constitute the lead electrodes 204 of the laminated inductor 200 are made to be larger than the diameters of the via holes which constitute the coil 202. Therefore, when the green sheets having the connecting conductors formed thereon are laminated and pressed to manufacture the multilayer electronic component, a great allowance for the deviation of the positions of the via holes in the upper and lower layers is permitted. Therefore, complete deviation of the connecting conductors can be prevented.

Moreover, the lead electrodes 204 is branched into two sections. Therefore, the positions at which the first branch 211, the second branch 212 and the third branch 213 are formed are deviated from one another in the branch position, that is, in the portion in which the connection with the connecting conductor 220 is established. Thus, when the green sheets having the connecting conductors are laminated in manufacturing process, the positions of the stepped portions formed by the connecting conductors do not concentrate on a straight line extending in the direction of lamination. Therefore, stress produced by the stepped portions can be dispersed. As a result, deviation of the positions of the via holes can be prevented. Moreover, the connecting conductors provided for the via holes can easily be connected to one another.

Therefore, defective connection of the lead electrodes 204 can satisfactorily be prevented. As a result, manufacturing yield can be improved.

Since an area of exposure of the lead electrodes 204 on the end surface of the laminate 201 can be enlarged, the lead electrodes 204 and the terminal electrodes 203 can easily be connected to one another.

Since the via holes constituting the lead electrodes 204 are branched as described above, the surface area of the lead electrodes 204 can be enlarged. Thus, the skin effect can be improved and thus the high-frequency characteristic can be improved.

Although the lead electrodes 204 according to the second embodiment is branched into two sections at one position, the present invention is not limited to this. For example, branching at a plurality of positions or branching into three or more sections is able to further satisfactorily disperse the stress. Moreover, the connection among the connecting conductors constituting the lead electrodes 204 can easily be established.

Figure 6:
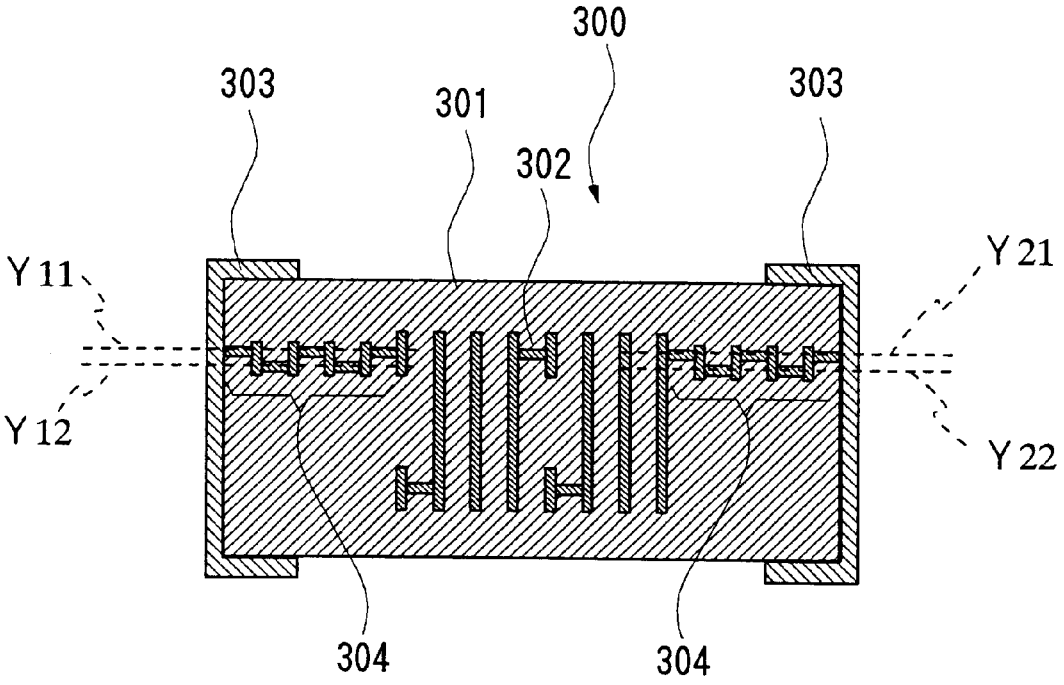
FIG. 6 is a side cross sectional view showing a laminated inductor according to a third embodiment.
Figure 7:
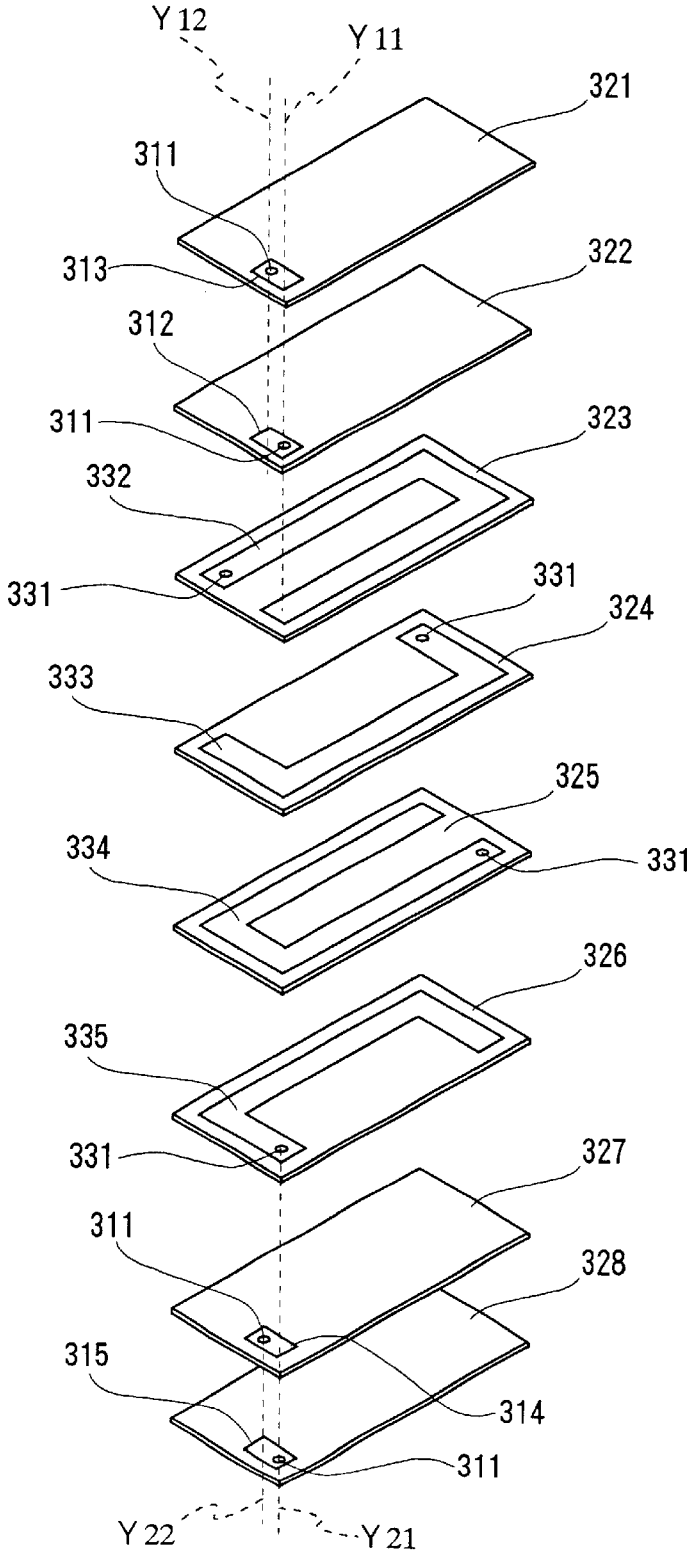
FIG. 7 is an exploded perspective view showing a laminate structure of a laminate according to the third embodiment.

A multilayer electronic component according to a third embodiment of the present invention will now be described with reference to FIGS. 6 and 7. A laminated inductor will now be described as an example of the multilayer electronic component. FIG. 6 is a side cross sectional view showing the laminated inductor. FIG. 7 is an exploded perspective view showing a laminate structure of a laminate.

Similarly to the laminated inductor 100, the laminated inductor 300 incorporates terminal electrodes 303 formed at two ends of a laminate 301 having a coil 302 embedded therein. A direction of lamination of the laminate 301 is substantially in parallel with a direction in which the terminal electrodes 303 are connected to each other.

The laminated inductor 300 is different from the laminated inductor 100 in the structures of lead electrodes 304 for establishing the connection between the coil 302 and the terminal electrodes 303 to one another. That is, as shown in FIGS. 6 and 7, the lead electrodes 304 are formed by alternately forming via holes 311 at the two ends of the laminate 301 for each layer on two different straight lines Y11, Y12, Y21 and Y22 extending in the direction of lamination. Moreover, connecting conductors provided for the via holes 311 are alternately connected to one another.

Similarly to the first embodiment, the lead electrodes 304 can easily be obtained by provided the via holes and connecting conductors for the upper-layer sheets and the lower-layer sheets.

That is, as shown in FIG. 7, an upper-layer sheet 322 having the via hole 311 provided with a connecting conductor 312 is laminated on the coil-layer sheet 323. The via hole 311 establishes the connection between conductor 312 and the end of the element conductor 332.

Moreover, an upper-layer sheet 321 having the via hole 311 provided with a connecting conductor 313 is laminated on the upper-layer sheet 322. When a laminating process is performed, the connecting conductors 313 and 312 are connected to each other. The connecting conductor 313 of the upper-layer sheet 321 which is the uppermost layer is connected to the terminal electrodes 303. The diameter of the via hole 311 is, for example, 50 $\mu$m.

A lower-layer sheet 327 having the via hole 311 provided with a connecting conductor 314 is laminated below the coil-layer sheet 326. The connecting conductor 314 is connected to an element conductor 325 through a via hole 331 formed in a coil-layer sheet 326.

Moreover, a lower-layer sheet 328 having the via hole 311 provided with a connecting conductor 315 is laminated below the lower-layer sheet 327. As a result, the connecting conductors 314 and 315 are connected to each other when a laminating process is performed. A connecting conductor 315 of the lower-layer sheet 328 which is the lowermost layer is connected to the terminal electrodes 303 through the via hole 311.

Similarly to the first embodiment, the coil 302 is formed by laminating the coil-layer sheets 323 to 326 having the corresponding element conductors 332 to 335. That is, the via holes 331 formed at the ends of the element conductors 332 to 335 establish the connection among the element conductors 332 to 335 so that the coil 302 is formed.

As a result of the above-mentioned structure, the lead electrodes 304 are formed by the plural connecting conductors 312 to 315 alternately connected in the direction of lamination.

The laminated inductor 300 has a structure that the via holes 311 for forming the lead electrodes 304 are not formed on one straight line extending in the direction of lamination. The via holes 311 are alternately formed on two different straight lines for each layer. Therefore, when green sheets having the connecting conductors are laminated in manufacturing process, the positions of the stepped portions formed by the connecting conductors are not concentrated on one straight line extending in the direction of lamination. Thus, stress produced in laminating process can be dispersed and thus deviation of the positions of the via holes can be reduced. That is, defective connection occurring among connecting conductors provided for the via holes can significantly be reduced. Moreover, manufacturing yield can be improved.

Although the diameter of each via hole for constituting the lead electrode 304 is made to be 50 $\mu$m as well as the conventional technique, the present invention is not limited to this. The diameter may be made to be 100 $\mu$m or larger as well as that according to the first and second embodiments. In the foregoing case, when the green sheets having the connecting conductors are laminated and pressed, a greater allowance is permitted for the deviation of the positions of the via holes in the upper and lower layers as compared with that permitted for the conventional technique. Therefore, complete deviation of the via holes can be prevented. Therefore, the connecting conductors for constituting the lead electrode 304 can easily be connected to one another.

In this embodiment, the connecting conductors are provided for the plural via holes formed on the two straight lines extending in the direction of lamination of the laminate 301. Moreover, the connecting conductors are connected to one another so that the lead electrode 304 is formed. The present invention, however, is not limited to this. Via holes may alternately be formed on three or more straight lines for each layer. Moreover, connecting conductors are provided for the via holes. The connecting conductors are connected to one another so that the lead electrode 304 is formed. In the foregoing case, the positions of the stepped portions formed by the connecting conductors can furthermore satisfactorily be dispersed. Therefore, stress produced by the stepped portions can furthermore sufficiently be dispersed. Thus, deviation of the positions of the via holes can furthermore be reduced.

Figure 8:
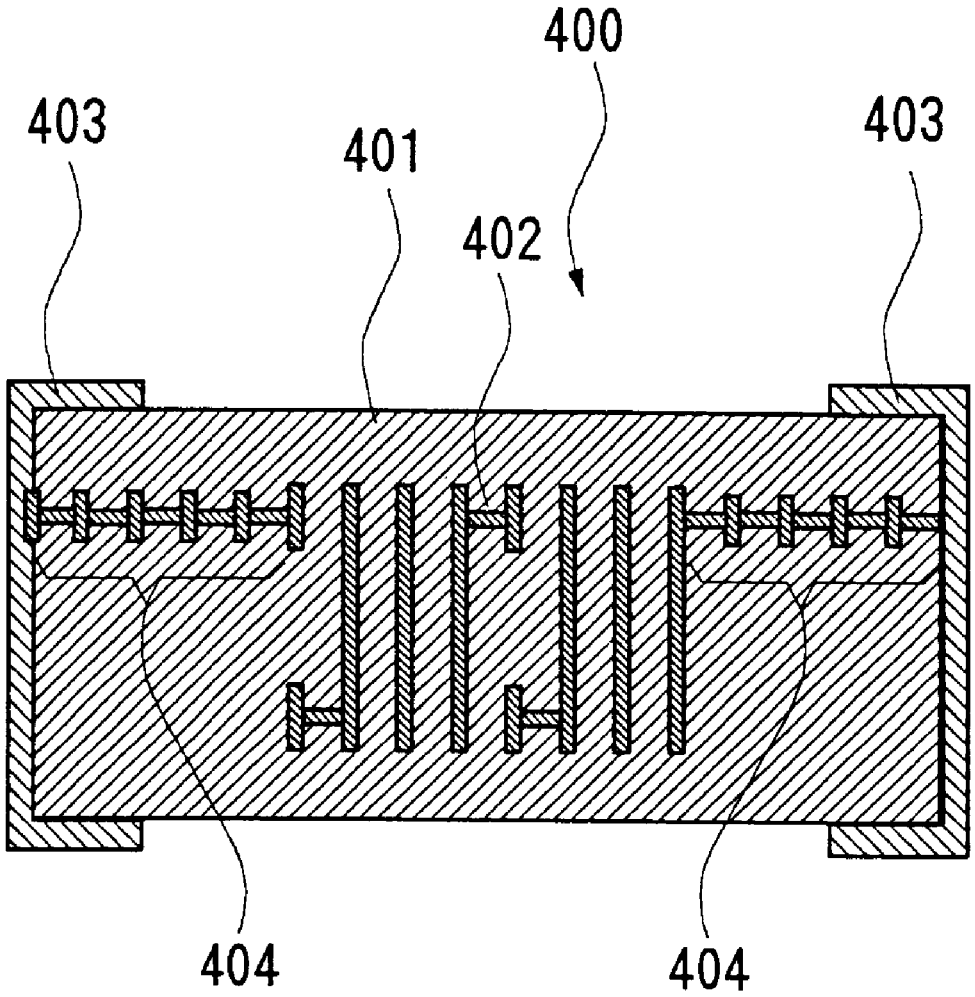
FIG. 8 is a side cross sectional view showing a laminated inductor according to a fourth embodiment.
Figure 9:
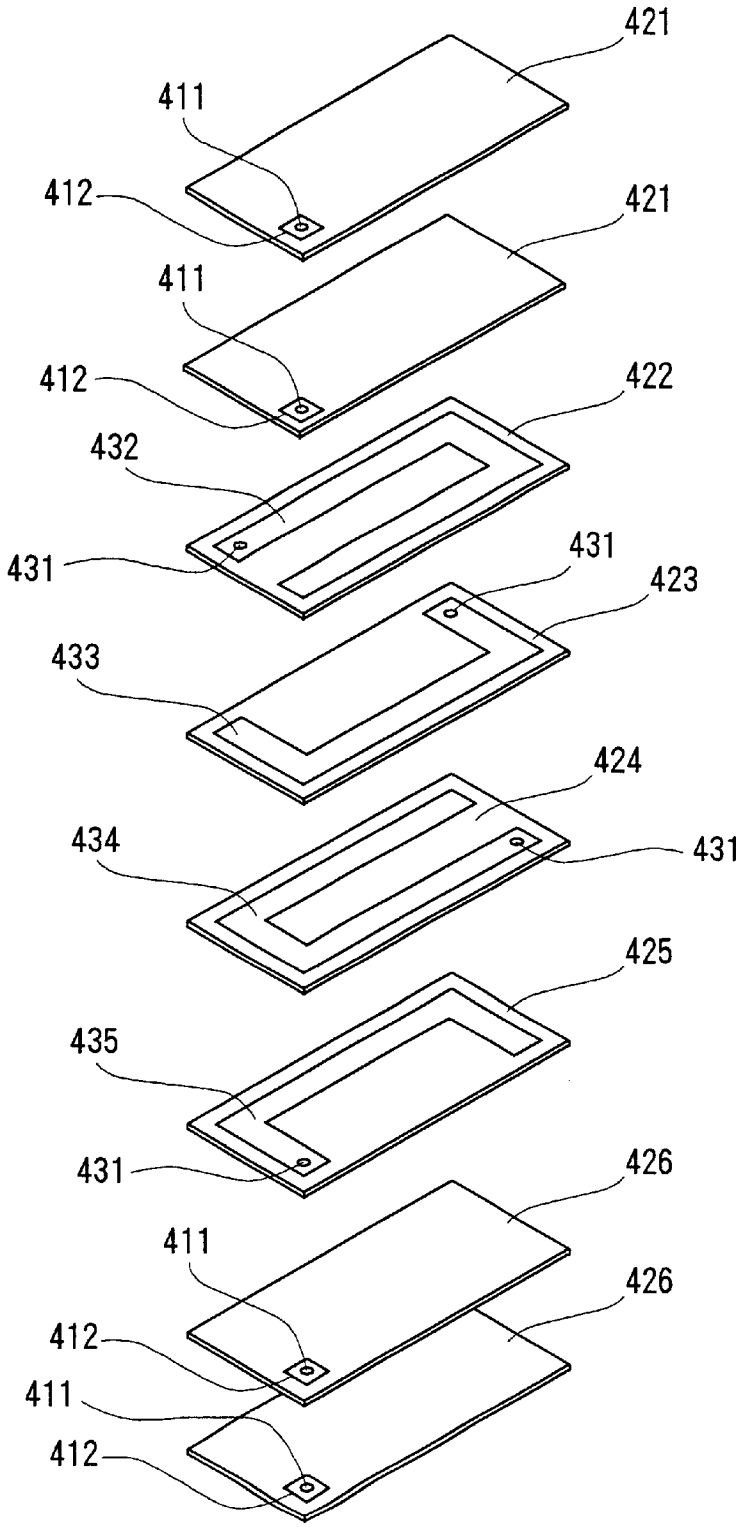
FIG. 9 is an exploded perspective view showing a laminate structure of a laminate according to the fourth embodiment.

A multilayer electronic component according to a fourth embodiment of the present invention will now be described with reference to FIGS. 8 and 9. A laminated inductor will now be described as an example of the multilayer electronic component. FIG. 8 is a side cross sectional view showing the laminated inductor. FIG. 9 is an exploded perspective view showing a laminate structure of a laminate.

Similarly to the laminated inductor 100, the laminated inductor 400 incorporates terminal electrodes 403 formed at two ends of a laminate 401 in which a coil 402 is embedded. A direction of lamination of the laminate 401 is substantially in parallel with a direction in which the terminal electrodes 403 are connected to each other.

The laminated inductor 400 is different from the laminated inductor 100 in the structure of a lead electrode 404 for establishing the connection between the coil 402 and the terminal electrodes 403. That is, as shown in FIGS. 8 and 9, the lead electrode 404 is formed at two ends of the laminate 401 by establishing the connection among connecting conductors 412 provided for a plurality of via holes 411 formed on one straight line extending in a direction of lamination. The diameter of the via holes 411 is made to be 50 $\mu$m.

Each of the connecting conductors 412 is formed to project over the outer end of the via hole 411 by at least a radius of the via hole 411. That is, the area of the connecting conductor 412 is larger than a circle having a diameter which is twice larger than the diameter of the via hole 411. The shape of each of the connecting conductors 412 is not limited to the circle. If the above-mentioned conditions are satisfied, another shape may be employed. In this embodiment, the shape is a square, each side of which has a length of 100 $\mu$m.

Similarly to the first embodiment, the lead electrode 404 can easily be obtained by providing the via holes and the connecting conductors for the upper-layer sheets and the lower-layer sheets.

That is, as shown in FIG. 9, one or more upper-layer sheets 421 having the via holes 411 provided with the connecting conductor 412 are laminated on the coil-layer sheet 422. FIG. 9 shows a two-layer structure. The via holes 411 establish the connection among the connecting conductors 412 and the ends of the element conductors 432. A connecting conductor 412 of the upper-layer sheet 421 which is the uppermost layer is connected to the terminal electrodes 403.

One or more lower-layer sheets 426 having the via hole 411 provided with the connecting conductor 412 are laminated below the coil-layer sheet 425. FIG. 9 shows a two-layer structure. The via hole 411 connects the connecting conductor 412 to the end of the element conductor 435. The via hole 411 connects the connecting conductor 412 of the lower-layer sheet 426 which is the lowermost layer to the terminal electrode 403.

As a result, the plural connecting conductors 412 connected in the direction of lamination constitute the lead electrode 404.

Similarly to the first embodiment, the coil 402 is formed by laminating coil-layer sheets 422 to 425 having the corresponding element conductors 432 to 435. That is, the via holes 431 formed at the ends of the element conductors 432 to 435 establish the connection among the element conductors 432 to 435 so that the coil 402 is formed.

The connecting conductor 412 of the laminated inductor 400 projects over the via hole 411 by at least the radius of the via hole 411. Therefore, when green sheets are laminated and pressed to manufacture the multilayer electronic component, a great allowance is permitted for the deviation of the positions by the connecting conductors, even if stress is produced by the stepped portions of the connecting conductors and therefore positions of the via holes are deviated. Thus, connecting conductors provided for the via holes are electrically conducted to one another. As a result, defective connection among the connecting conductors can significantly be prevented. Thus, the manufacturing yield can be improved.

Although the diameter of each via hole 411 of the lead electrode 404 is made to be 50 $\mu$m similarly to the conventional technique, the present invention is not limited to this. The diameter may be made to be 100 $\mu$m or larger as well as that according to the first and second embodiments. Moreover, the area of the connecting conductor may be enlarged. In the foregoing case, when the green sheets are laminated and pressed in manufacturing process, a greater allowance is permitted for the deviation of the positions of the via holes in the upper and lower layers. Therefore, complete deviation of the via holes can be prevented. Therefore, the connecting conductors can easily be connected to one another.

Figure 10:
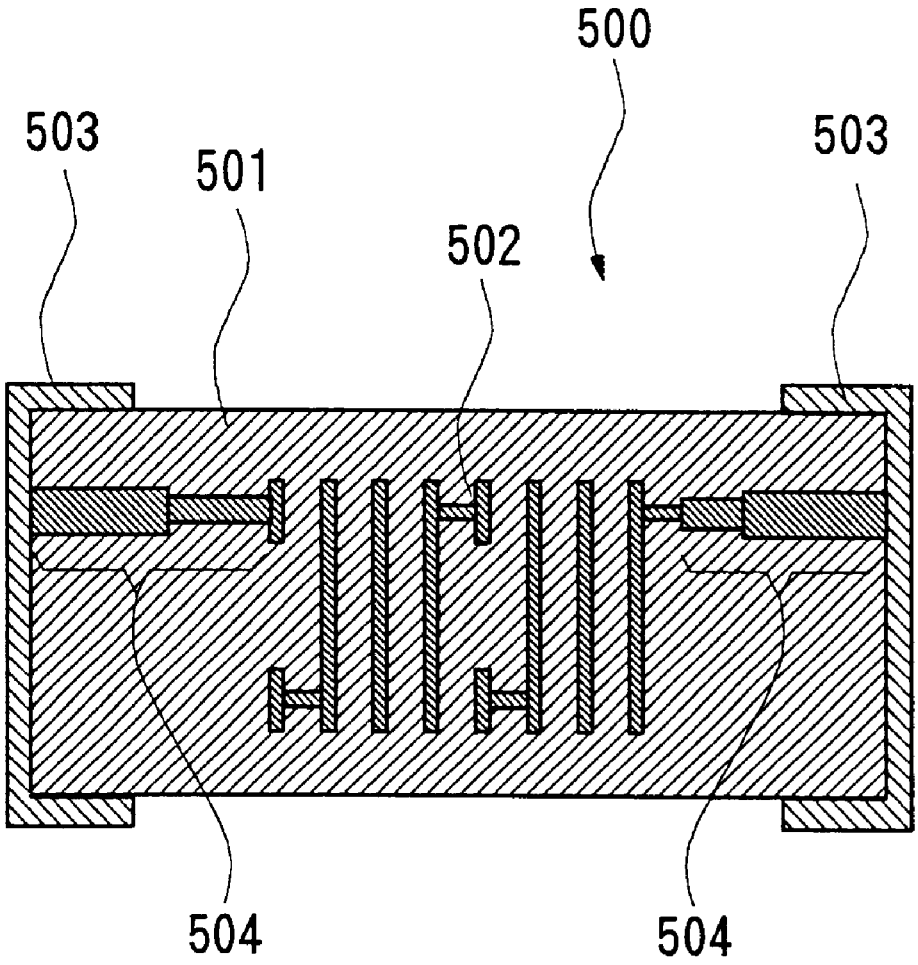
FIG. 10 is a side cross sectional view showing a laminated inductor according to a fifth embodiment.
Figure 11:
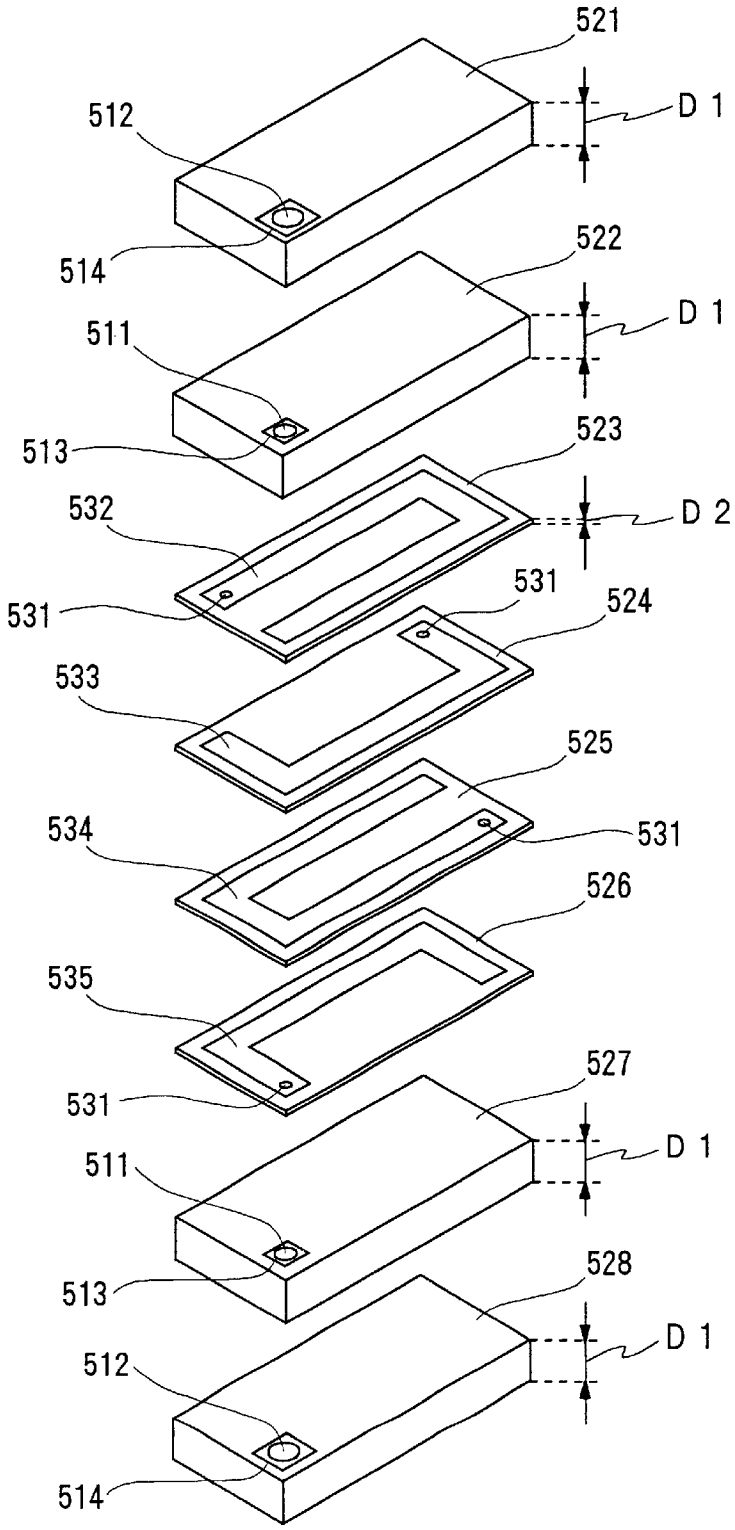
FIG. 11 is an exploded perspective view showing a laminate structure of a laminate according to the fifth embodiment.

A multilayer electronic component according to a fifth embodiment of the present invention will now be described with reference to FIGS. 10 and 11. A laminated inductor will now be described as an example of a multilayer electronic component. FIG. 10 is a side cross sectional view showing the laminated inductor. FIG. 11 is an exploded perspective view showing a laminate structure of a laminate.

Similarly to the laminated inductor 100, the laminated inductor 500 incorporates terminal electrodes 503 formed at two ends of a laminate 501 in which a coil 502 is embedded. A direction of lamination of the laminate 501 is substantially in parallel with a direction in which the terminal electrodes 503 are connected to each other.

The laminated inductor 500 is different from the laminated inductor 100 in that a structure for forming a lead electrode 504 for establishing the connection among the coil 502 and the terminal electrodes 503.

As shown in FIGS. 10 and 11, the lead electrode 504 is formed by, at two ends of the laminate 501, establishing the connection between connecting conductors 513 and 514 provided for via holes 511 and 512 to each other. The diameter of each of the via holes 511 and 512 is made to be values as well as that according to the first embodiment. That is, the via holes 511 and 512 are larger than the via hole 531 which constitutes the coil 502. It is preferable that the size is twice or more times. The via hole 512 adjacent to the terminal electrode 503 is larger than the via hole 511 adjacent to the coil 502. It is preferable that size is 1.5 times or more. In this embodiment, the diameter of the via hole 531 constituting the coil 502 is 50 $\mu$m, that of the via hole 511 adjacent to the coil is 100 $\mu$m and that of the via hole 512 adjacent to the terminal electrode 503 is 150 $\mu$m.

This embodiment is different from the first embodiment in that thickness D1 of each of upper-layer sheets 521 and 522 and lower-layer sheets 527 and 258 is larger than thickness D2 of each of coil-layer sheets 523 to 526.

That is, the thickness D2 of each of the coil-layer sheets 523 to 526 is made to be 50 $\mu$m and the thickness D1 of each of the upper-layer sheets 521 and 522 and the lower-layer sheets 527 and 528 is made to be 300 $\mu$m.

The upper-layer sheets 521 and 522 and the lower-layer sheets 527 and 528 are laminated at the following positions.

One or more upper-layer sheets 522 each having the via hole 511 provided with the connecting conductor 513 are laminated on the coil-layer sheet 523. FIG. 11 shows a single-layer structure. The via hole 511 establishes the connection between the connecting conductor 513 and the end of the element conductor 532.

One or more upper-layer sheets 521 each having the via hole 512 provided with the connecting conductor 514 are laminated on the upper-layer sheet 522. FIG. 11 shows a single-layer structure. Thus, the connecting conductor 514 is connected to the connecting conductor 513 in laminating process. The connecting conductor 514 of the upper-layer sheet 521 which is the uppermost layer is connected to the terminal electrodes 503.

One or more lower-layer sheets 527 each having the via hole 511 provided with the connecting conductor 513 are laminated below the coil-layer sheet 526. FIG. 11 shows a single-layer structure. The connecting conductor 513 is connected to an element conductor 535 by the via hole 531 formed in the coil-layer sheet 526.

Moreover, one or more lower-layer sheets 528 each having the via hole 512 provided with the connecting conductor 514 are laminated below the lower-layer sheet 527. FIG. 11 shows a single-layer structure. Thus, the connecting conductor 514 is connected to the connecting conductor 513 when a laminating process is performed. The connecting conductor 514 of the lower-layer sheet 527 which is the lowermost layer is connected to the terminal electrodes 503 through the via hole 512.

The plural connecting conductors 512 and 513 constitute the lead electrode 504.

Similarly to the first embodiment, the coil 502 is formed by laminating the coil-layer sheets 523 to 526 having the corresponding element conductors 532 to 535. That is, the via holes 531 formed at the ends of the element conductors 532 to 535 establish the connection among the element conductors 532 to 535 so that the coil 502 is formed.

The laminated inductor 500 has a structure that the thickness D1 of each insulating sheet which constitutes the lead electrode 504 is larger than the thickness D2 of each insulating sheet which constitute the coil 502. Therefore, the number of the via holes 511 and 512 which constitute the lead electrode 504 can be reduced. Therefore, formation of stepped portions by the connecting conductors can be prevented in manufacturing process and the positions at which the stepped portions are occurred can be dispersed. Therefore, stress produced owning to the stepped portions can be reduced. Moreover, deviation of the positions of the via holes which constitute the lead electrode can be prevented. As a result, electrical connection between the connecting conductors can reliably be established. Thus, defective connection can significantly be prevented. Therefore, manufacturing yield can be improved.

Since the number of the upper-layer sheets and the lower-layer sheets which constitute the lead electrode 504 and which must be laminated can be reduced, the productivity can be improved. Moreover, the numbers of the via holes and the connecting conductors in the direction from the coil 502 to the terminal electrodes 503 can be reduced. Therefore, the distance of the skin of the lead electrode 504 in the foregoing direction can be shortened. Thus, the effective resistance produced by the skin effect can be reduced. As a result, the characteristics in the high-frequency region can be improved.

Figure 12:
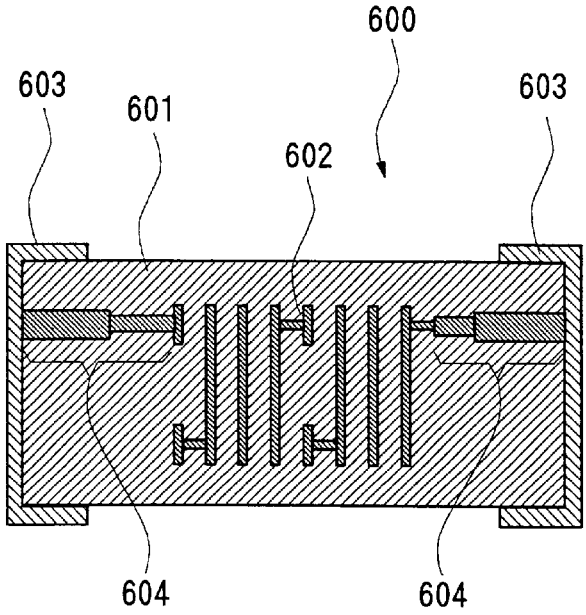
FIG. 12 is a side cross sectional view showing a multilayer electronic component according to a sixth embodiment.
Figure 13:
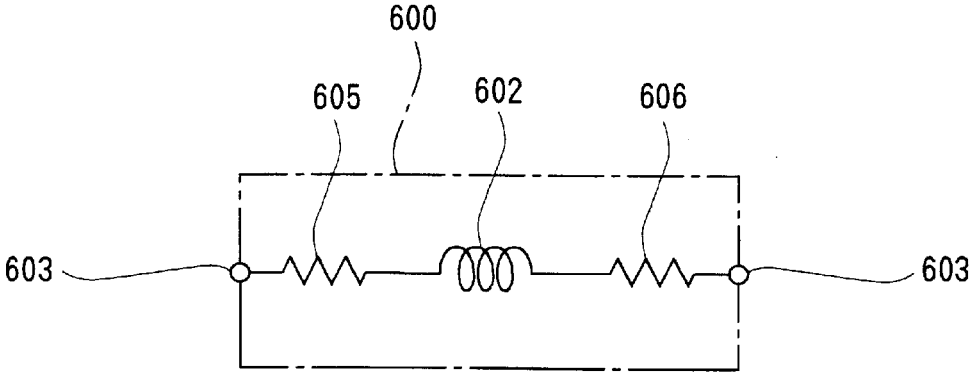
FIG. 13 is a diagram showing an equivalent circuit to the multilayer electronic component according to the sixth embodiment.

A multilayer electronic component according to a sixth embodiment of the present invention will now be described with reference to FIGS. 12 and 13. FIG. 12 is a side cross sectional view showing the multilayer electronic component. FIG. 13 is a circuit equivalent to the multilayer electronic component.

The multilayer electronic component 600 is different from the laminated inductor 100 in that a lead electrode 604 is constituted by resistance conductors. Thus, the multilayer electronic component 600 is in the form of a composite component formed by series connection of a coil 602 and resistors 605 and 606 to one another. Since the lead electrode 604 is constituted by the resistance conductors, the resistors 605 and 606 can easily be formed in the laminate 601.

The structure is similar to that according to the first embodiment except for the lead electrode 604 which is constituted by the resistance conductors. Thus, an effect similar to that obtainable from the first embodiment can be obtained.

Figure 14:
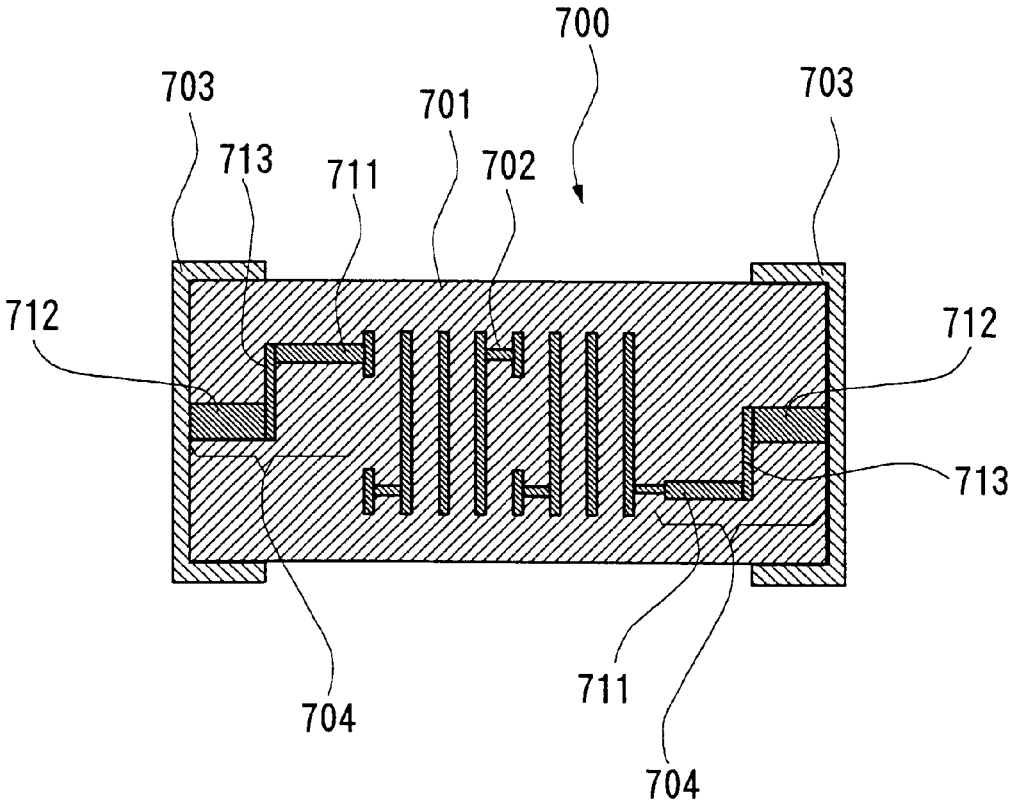
FIG. 14 is a side cross sectional view showing a laminated inductor according to a seventh embodiment.
Figure 15:
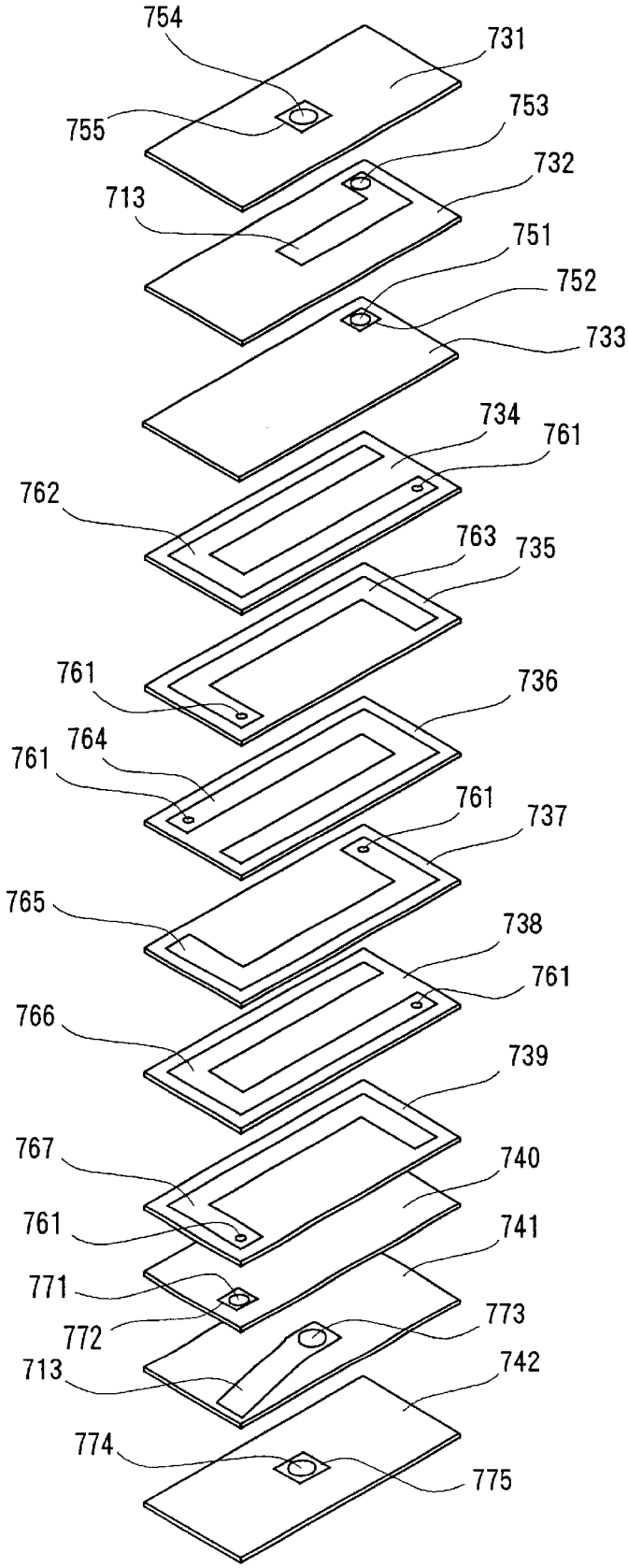
FIG. 15 is an exploded perspective view showing a laminate structure of a laminate according to the seventh embodiment.

A multilayer electronic component according to a seventh embodiment of the present invention will now be described with reference to FIGS. 14 and 15. A laminated inductor will now be described as an example of the multilayer electronic component. FIG. 14 is a side cross sectional view showing the laminated inductor. FIG. 15 is an exploded perspective view showing a laminate structure of a laminate.

Similarly to the laminated inductor 100, the laminated inductor 700 incorporates terminal electrodes 703 formed at two ends of a laminate 701 in which a coil 702 is embedded. A direction of lamination of the laminate 701 is substantially in parallel with a direction in which the terminal electrodes 703 are connected to each other.

The laminated inductor 700 is different from the laminated inductor 100 in that the lead electrode 704 is disposed at the center of a magnetic flux of the coil 702 at an intermediate position of the leading. That is, as shown in FIG. 14, the lead electrode 704 is composed of a first branch 711 extending from an end of the coil 702 toward the terminal electrode 703 and a second branch 712, at the center of the magnetic flux of the coil 702, extending from an end surface of a laminate 701 toward the coil 702. An end of the first branch 711 and an end of the second branch 712 are connected to each other through a connecting conductor 713.

Similarly to the first embodiment, the terminal electrodes 704 can easily be obtained by providing via holes and connecting conductors for upper-layer sheets and lower-layer sheets.

That is, as shown in FIG. 15, one or more upper-layer sheets 733 are laminated on a coil-layer sheet 734. FIG. 15 shows a single-layer structure. The sheet 733 has a via hole 751. Moreover, the sheet 733 has a connecting conductor 752 arranged to be connected to the via hole 751. The via hole 751 establishes the connection between the connecting conductor 752 and an end of an element conductor 762.

Moreover, one upper-layer sheets 732 are laminated on the upper-layer sheet 733. The sheet 732 has a via hole 753. Moreover, the sheet 732 has the connecting conductor 713 arranged to be connected to the via hole 753. The connecting conductor 713 is formed into an L-shape from an end at which the via hole 753 is formed toward the center of the sheet 732. The via hole 753 establishes the connection between the connecting conductor 752 and the connecting conductor 713.

In addition, one or more upper-layer sheets 731 are laminated on the upper-layer sheet 732. FIG. 15 shows a single-layer structure. A via hole 754 is formed at the center of the sheet 731. The sheet 731 has a connecting conductor 755 arranged to be connected to the via hole 754. The via hole 754 establishes the connection between the connecting conductor 755 and the connecting conductor 713. A connecting conductor 755 of the upper-layer sheet 731 which is the uppermost layer is connected to the terminal electrodes 703. Note that the upper-layer sheet 731 has a thickness larger than that of each of the other upper-layer sheets 732 and 733.

One or more lower-layer sheets 740 are laminated below the coil-layer sheet 739. FIG. 15 shows a single-layer structure. The sheet 740 has a via hole 771. The sheet 740 has a connecting conductor 772 arranged to be connected to the via hole 771. The connecting conductor 772 is connected to an end of an element conductor 767 through a via hole 761 formed in the coil-layer sheet 739.

One lower-layer sheet 741 is laminated below the lower-layer sheet 740. A via hole 773 is formed at the center of the sheet 741. Moreover, the sheet 741 has the connecting conductor 713 arranged to be connected to the via hole 773. The connecting conductor 713 is formed into a substantially straight-line shape from the center at which the via hole 773 is formed toward a corner of the sheet 741. The connecting conductor 713 is connected to the connecting conductor 772 through the via hole 771 formed in the lower-layer sheet 740. Note that the lower-layer sheet 741 has a thickness larger than that of the lower-layer sheet 740.

One or more lower-layer sheets 742 are laminated below the lower-layer sheet 741. FIG. 15 shows a single-layer structure. A via hole 774 is formed at the center of the sheet 742. The sheet 742 has a connecting conductors 775 arranged to be connected to the via hole 774. Each of the connecting conductors 775 is connected to the connecting conductor 713 through the via hole 773 formed in the lower-layer sheet 741. The connecting conductors 775 of the lower-layer sheet 742 which is the lowermost layer is connected to the terminal electrodes 703 through the via hole 774. Similarly to the lower-layer sheet 741, the thickness of the lower-layer sheet 742 is larger than that of the lower-layer sheet 740.

Similarly to the first embodiment, the coil 702 is formed by laminating coil-layer sheets 734 to 739 having corresponding element conductors 762 to 767. That is, the via holes 761 formed at the ends of the element conductors 762 to 767 establish the connection among the element conductors 762 to 767 so that the coil 702 is formed.

As a result of the above-mentioned structure, the lead electrode 704 composed of the first branch 711 and the second branch 712 is formed. The diameter of each via hole which constitutes the lead electrode 704 is made to be larger than that of the via hole 761 which constitutes the coil 702. It is preferable that the diameter is about twice or more times. The diameter of each of the via holes 754, 773 and 774 which constitute the second branch 712 is made to be larger than that of the via holes 751, 753 and 771 which constitute the first branch 711. It is preferable that the diameter is about 1.5 times or more. For example, the diameter of the via hole 761 which constitutes the coil 702 is about 50 $\mu$m, the diameter of each of the via holes 751, 753 and 771 which constitute the first branch 711 is made to be about 100 $\mu$m and the diameter of each of the via holes 754, 773 and 774 which constitute the second branch 712 is made to be about 150 $\mu$m.

The laminated inductor 700 incorporates the lead electrode 704 which is formed at the center of the magnetic flux of the coil 702 at an intermediate position of leading. Therefore, the distance from the second branch 712 to the terminal electrode 703 which reaches the side surface of the laminate 701 can be elongated. As a result, a float capacity produced between the lead electrode 704 and the terminal electrodes 703 can be reduced. Since the second branch 712 is formed at the center of the magnetic flux, the diameter of each of the via holes which constitute the second branch 712 can be enlarged without any adverse influence from the terminal electrodes 703. Thus, the connection can easily be established. The other operation and effect are similar to those of the laminated inductor 100 according to the first embodiment.

Figure 16:
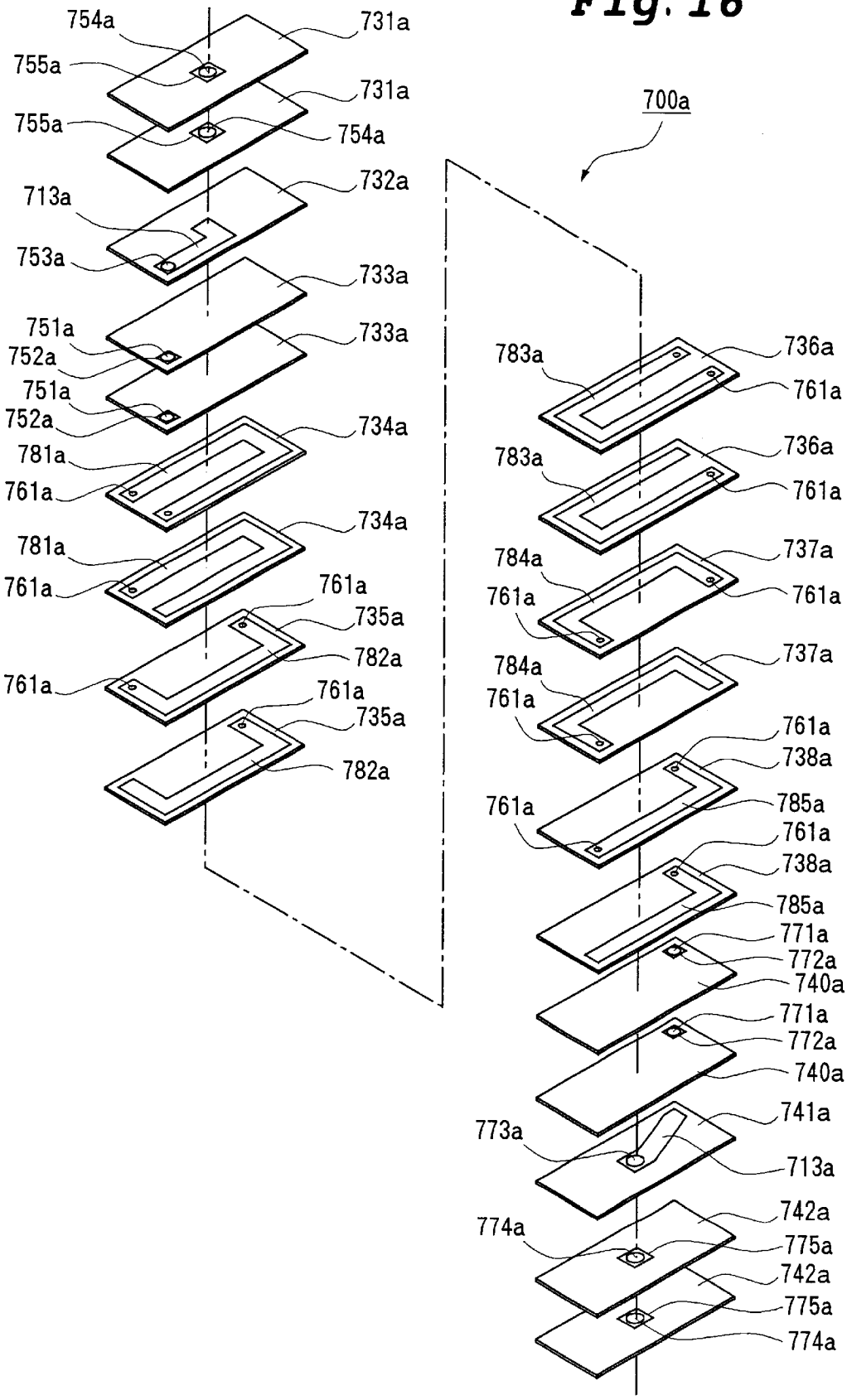
FIG. 16 is an exploded perspective view showing a laminate structure of a laminate according to a modification of the seventh embodiment.

A modification of this embodiment will now be described with reference to FIG. 16. FIG. 16 is an exploded perspective view showing a laminate structure of a laminated inductor 700*a*. Referring to the drawing, the same elements as those shown in FIG. 15 are given the same reference numerals. The laminated inductor 700*a* and the laminated inductor 700 are different from each other in the structure of the coil. That is, as shown in FIG. 16, sheets 734*a* to 738*a* are laminated such that every two element conductors of element conductors 781*a* to 785*a* which constitute the coil are disposed so as to be connected in parallel with each other. Thus, electric resistance of the coil can be reduced.

Although the first to fifth embodiments and the seventh embodiment have been described about the laminated inductors as an example of the multilayer electronic components, the present invention is not limited to the inductor. That is, any multilayer electronic components having terminal electrodes at the two ends in the direction of lamination of the chip—other electronic components, composite electronic components or the like than the inductor—can attain a similar effect.

The present invention is arranged to enlarge an allowance of divination of the positions of the connecting conductors, which constitute the lead electrode, and the via holes of the connecting conductors and disperse stress which causes the deviation of the positions so as to prevent defective connection among the connecting conductors. Therefore, the present invention is not limited to the foregoing embodiments. If the structures of the embodiments are combined, a similar effect can be obtained.

Figure 17:
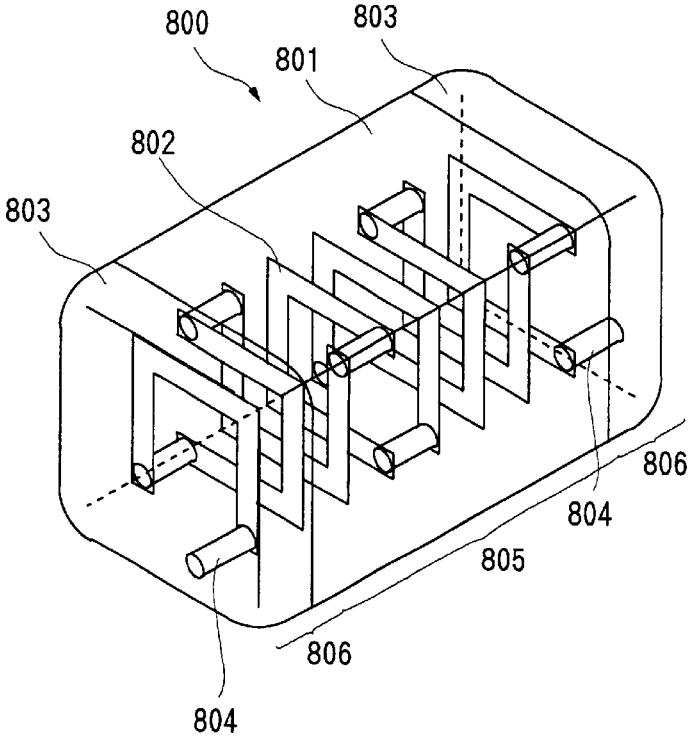
FIG. 17 is a schematic perspective view showing a laminated inductor according to an eighth embodiment.
Figure 18:
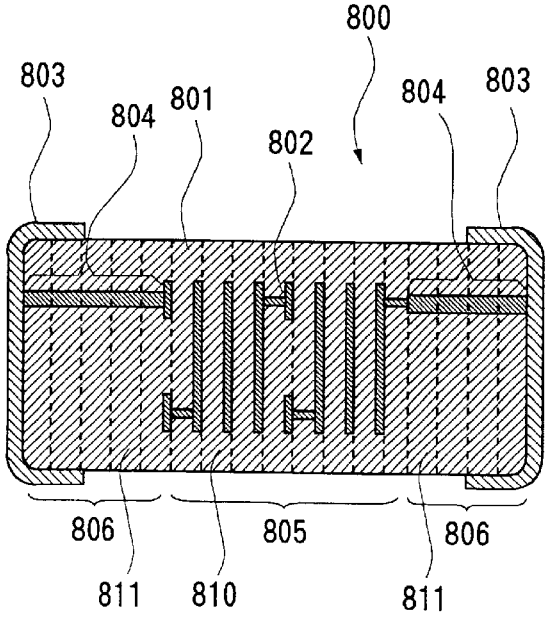
FIG. 18 is a side cross sectional view showing the laminated inductor according to the eighth embodiment.
Figure 19:
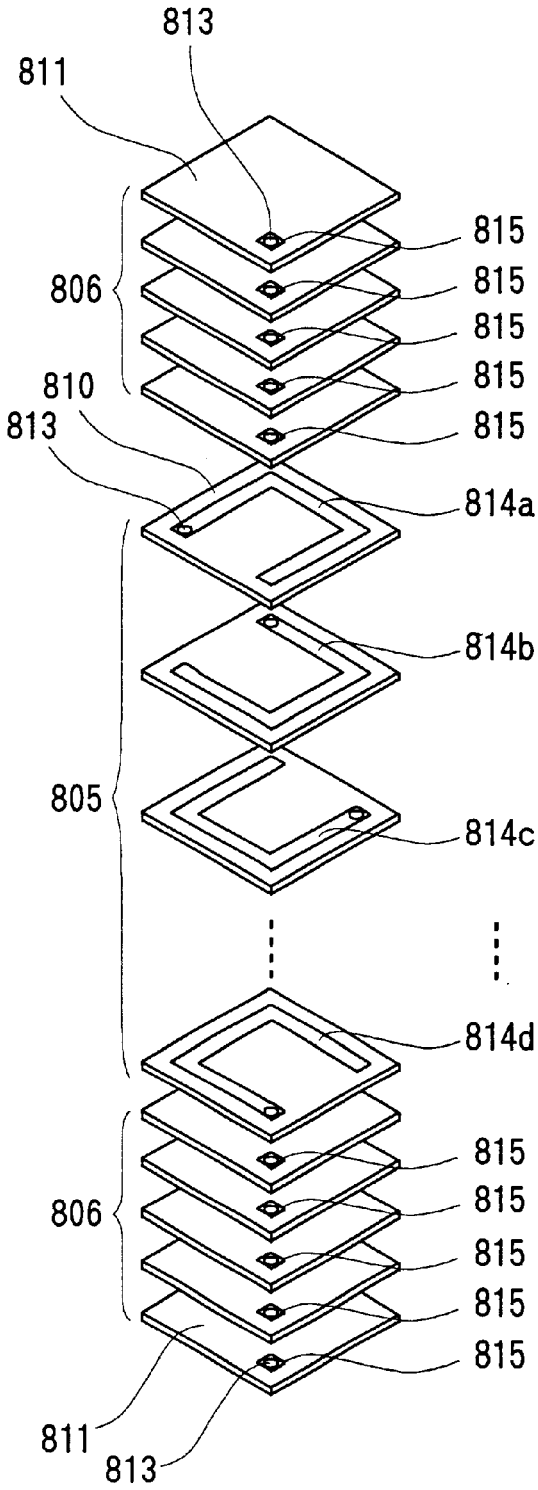
FIG. 19 is an exploded perspective view showing a laminate structure of a laminate according to the eighth embodiment.
Figure 20:
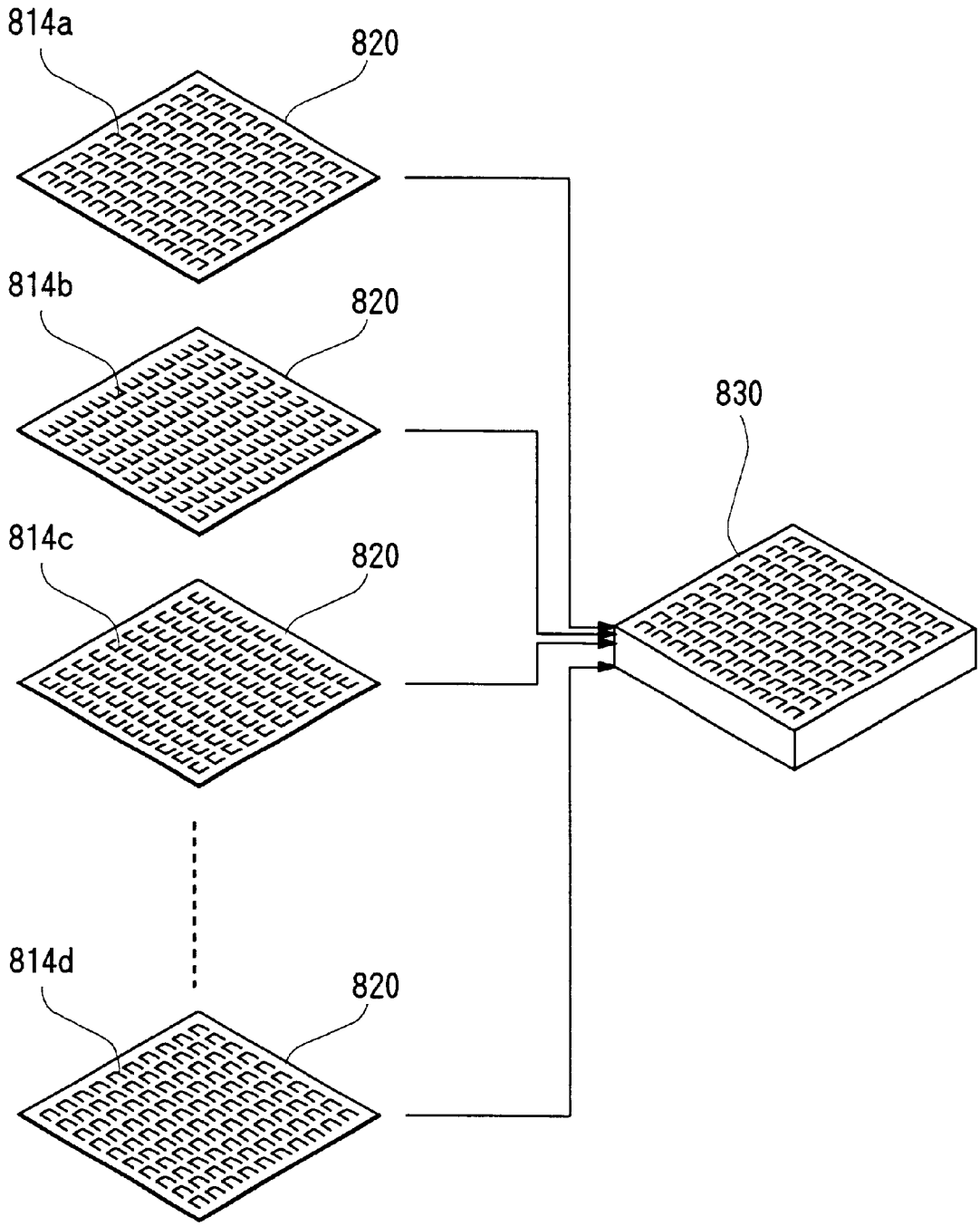
FIGS. 20 to 22 are perspective views showing a manufacturing process of the laminated inductor according to the eighth embodiment.
Figure 21:
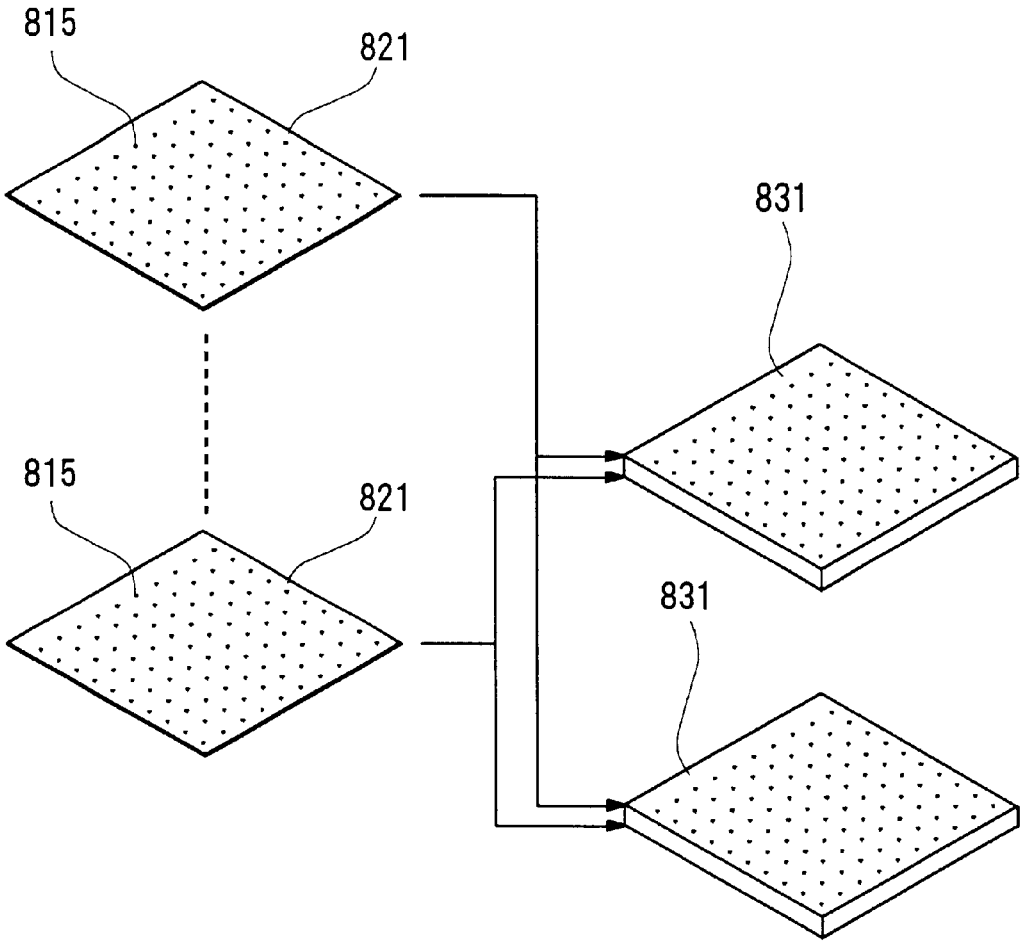
Figure 22:
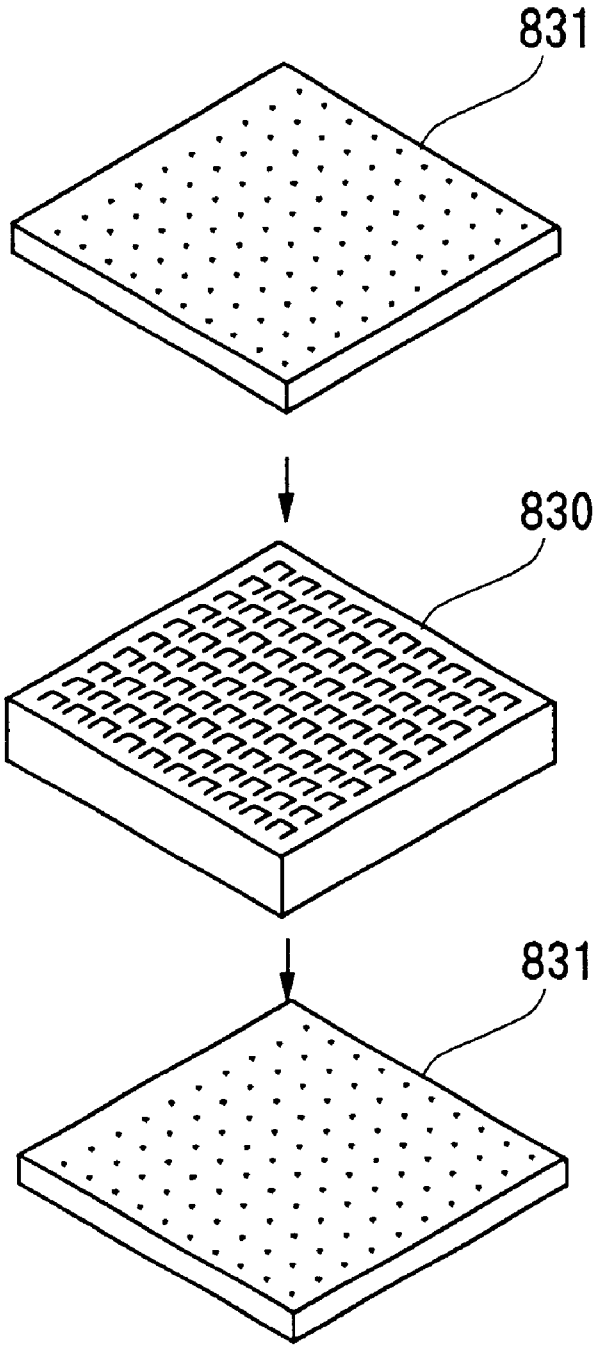

A method of efficiently manufacturing a multiplicity of multilayer electronic components will now be described with reference to FIGS. 17 to 22. In this embodiment, a method of manufacturing laminated inductors will now be described as an example of a method of manufacturing multilayer electronic components. FIG. 17 is a schematic perspective view showing a laminated inductor. FIG. 18 is a side cross sectional view showing the laminated inductor. FIG. 19 is an exploded perspective view showing a laminate structure of a laminate. FIGS. 20 to 22 are perspective views showing a manufacturing process.

A method of manufacturing a laminated inductor 800 as shown in FIG. 17 will now be described. Initially, the structure of the laminated inductor 800 will now be described. The laminated inductor 800 incorporates a substantially rectangular parallelepiped laminate 801, which embeds a coil 802, and terminal electrodes 803 formed to the two lengthwise directional ends of the laminate 801 and electrically connected to the coil 802. The laminate 801 is formed by laminating a plurality of a substantially-square first insulating layers 810 and second insulating layers 811.

A direction of lamination of the laminate 801 is the lengthwise direction thereof.

In the central portion 805 of the laminate 801 in the direction of lamination, plural types of element conductors 814*a* to 814*d* are formed on the first insulating layers 810 to be spiral through the via holes 813. That is, in the central portion 805, the element conductors 814*a* to 814*d* constitute the coil 802. At the two ends 806 of the laminate 801, the connecting conductors 815 are formed on the second insulating layers 811 such that an internal circuit is exposed over the end surface of the laminate 801 through the via holes 813. The terminal electrodes 803 is formed to be connected to the connecting conductors 815 exposed over the end surface of the laminate 801. That is, at the ends 806 of the laminate 801, the connecting conductors 815 constitute a lead electrode 804 which establishes the connection between the coil 802 and the terminal electrodes 803.

The laminated inductor 800 is manufactured as follows: initially, Ni—Zn—Cu ceramic powder, an organic binder and solvent are injected into a ball mill so as to be mixed sufficiently. Thus, first slurry which is suspension is prepared. Then, for example, a doctor blade method is employed to form the first magnetic sheets 820, which are ceramic green sheets, from the slurry. The doctor blade method is performed such that the slurry is allowed to flow on a base film and the thickness is adjusted by changing the distance from the doctor blade. Then, the slurry is dried so that the first magnetic-material sheets 820 each having a predetermined thickness are obtained. In this embodiment, each of the first magnetic-material sheets 820 has a thickness of about 20 $\mu$m. Then, each of the first magnetic-material sheet 820 is punched to have a predetermined size. For example, 10 cm×10 cm rectangular sheets are formed.

Then, a plurality of element conductors are formed on the first magnetic-material sheets 820 obtained by punching. Although the actual number of the element conductors is, for example, 10,000, the drawing shows about 100 element conductors.

Then, via holes are formed at predetermined positions of the first magnetic-material sheets 820 by using laser beams. Then, conductive paste mainly composed of, for example, Ag is printed to have a predetermined pattern by a screen printing method. As a result of the printing process, the via holes are filled with the conductive paste. In this case, to correspond to the coil 802 of the laminated inductor, the conductor paste is printed on the plural first magnetic-material sheets 820 to have the patterns of the element conductors 814*a* to 814*d*. That is, the foregoing process causes a plurality of the first magnetic-material sheets 820 to be manufactured such that adjacent sheets have different patterns. In this embodiment, fifty two first magnetic-material sheets 820 are manufactured. When the first magnetic-material sheets 820 are laminated, a ten-turn coil 802 is composed of the element conductors 814*a* to 814*d*.

Then, as shown in FIG. 20, the fifty two first magnetic-material sheets 820 are laminated in a predetermined order so that a first sheet laminate 830 is manufactured. The expression "laminating in a predetermined order" means that the first magnetic-material sheets 820 are edited and laminated in such a manner that the element conductors 814*a* to 814*d* are spirally formed in the first sheet laminate 830.

On the other hand, Ni—Zn—Cu ceramic powder, an organic binder and solvent are injected into a ball mill so as to be mixed sufficiently. Thus, second slurry which is suspension is prepared. The second slurry is different from the first slurry in that the quantity of the organic binder is enlarged. In this embodiment, the organic binder is mixed in a quantity larger than that of the first slurry by about 30%. Then, the same method as that for obtaining the first magnetic-material sheets 820 is employed so that second magnetic-material sheets 821 having the same shape are formed. The thickness of each of the second magnetic-material sheets 821 is the same as that of each of the first magnetic-material sheets 820.

Similarly to the first magnetic-material sheets 820, via holes are formed at predetermined positions of the second magnetic-material sheets 821 by laser beams. Then, conductor paste mainly composed of, for example, Ag is printed to have a predetermined pattern by the screen printing method. To correspond to the lead electrode 804 at the two ends 806 of the laminated inductor 800, the conductor paste is printed on the plural second magnetic-material sheets 821 to have the pattern of the connecting conductor 815. That is, a plurality of second magnetic-material sheets 821, to which the same patterns have been printed, are manufactured in the above-mentioned process. In this embodiment, 10 second magnetic-material sheets 821 are manufactured. The diameter of each of the formed via holes is the same as that of each of the via holes formed in the first magnetic-material sheets 820.

Then, as shown in FIG. 21, two second sheet laminates 831 are formed from the 10 second magnetic-material sheets 821, each of the second sheet laminates 831 being formed by laminating 5 second magnetic-material sheets 821. Since the process is different from the process for forming the first sheet laminate 830 in that the same patterns are printed to all of the second sheet laminates 831, the foregoing edition process is not required. Therefore, the second sheet laminates 831 can efficiently be manufactured.

Then, as shown in FIG. 22, the laminates of the sheets are formed in a laminating order as the second sheet laminate 831, the first sheet laminate 830 and the second sheet laminate 831, after which pressing is performed under a pressure of 0.5 t/cm$^2$. Thus, the laminate 832 of sheets is obtained.

Then, the laminate 832 of sheets is cut to have a size of each unit component so that rectangular parallelepiped laminates are manufactured. Then, the laminates were burnt at about 500° C. for one hour to volatilize excess binder. That is, a binder removal process is performed. Then, the corners of each laminate is rounded by barrel polishing or the like.

Then, the laminates are burnt in the atmosphere so that the substantially rectangular parallelepiped laminates 801 are manufactured. Finally, the terminal electrodes 803 are formed at the two ends of each of the laminate 801 by dipping method or the like. Thus, the laminated inductors 800, each of which is an example of the multilayer electronic component, are manufactured.

The above-mentioned method of manufacturing the multilayer electronic component enables the central portion 805 in which the coil 802 has been formed and the two ends 806 in which the lead electrode 804 has been formed to be manufactured by using individual laminate of sheets. Therefore, each of the laminate of sheets can efficiently be manufactured. That is, when the second sheet laminates 831 to be formed into the two ends 806 are manufactured, a process different from that for manufacturing the first sheet laminates 830 is employed, which does not require the process for editing the second magnetic-material sheets 821. Therefore, the manufacturing efficiency can be improved because the manufacturing process can efficiently be performed. When laminated inductors of different types are manufactured, the second sheet laminates 831 may be the same laminates as those according to this embodiment. That is, only the second sheet laminates 831 can be manufactured, causing the productivity to be improved. As a result, a variety of multilayer electronic components can optimally be manufactured. Since the second magnetic-material sheets 821 are made of the material containing a large quantity of the binder, the hardness of each end of the laminate 801 can be increased. As a result, burrs and breakage can be prevented in the polishing step in the manufacturing process, causing the manufacturing yield to be improved.

In this embodiment, the conductor paste printed so as to be applied to the first magnetic-material sheets 820 and the second magnetic-material sheets 821 is the same material mainly composed of Ag. However, the first conductive paste 840 which is applied to the first magnetic-material sheets 820 and the second conductive paste 841 which is applied to the second magnetic-material sheets 821 may be materials having different attributes. For example, the first conductive paste 840 may be composed of a material obtained by mixing Ag—Pd powder and a binder (for example, ethylcellulose) at a weight ratio of about 3:1. The second conductive paste 841 may be composed of a material obtained by mixing Cu powder and a binder at a weight ratio of bout 3:1. The conductive paste 840 or 841 may be made of a material having a high resistance. As described above, the element conductor and the connecting conductor can be made of conductor paste made of materials having different attributes. As a result, a variety of electronic components can be manufactured. For example, electronic components each having an LR composite function can easily be manufactured. That is, the second conductive paste 841 for forming the connecting conductor enables the resistance value to easily be adjusted. Since the first conductive paste 840 for forming the element conductors is not freely selectable due to a necessity of preventing internal stress and obtaining required characteristics as the coil, the foregoing manufacturing method is an effective method.

In this embodiment, the first magnetic-material sheets 820 and the second magnetic-material sheets 821 have the same thickness. The thicknesses may be different from each other. If the second magnetic-material sheets 821 have a large thickness, only a small number of sheets is required to manufacture the second sheet laminate 831. Therefore, the laminating process can be reduced and the manufacturing process can furthermore efficiently be completed. Moreover, the number of the via holes and the connecting conductors in a direction from the coil 802 to the terminal electrodes 803 can be reduced. Therefore, the distance of the skin of the lead electrode 804 in the above-mentioned direction can be shortened. As a result, the effective resistance determined by the skin effect can be reduced. Thus, the characteristics in the high-frequency region can be improved.

As described above, the method of manufacturing the multilayer electronic component enables the central portion 805 in which the coil 802 has been formed and the end 806 at which the lead electrode 804 has been formed can be manufactured by using individual sheet laminates 830 and 831. Therefore, a variety of the following multilayer electronic components can efficiently be manufactured. For example, multilayer electronic components each incorporating the central portion 805 and the end 806 in which the attributes of the insulating sheets are different from each other can efficiently be manufactured. The attributes of the insulating sheets means the characteristics and properties of the insulating sheets, for example, the thickness, hardness, composition, the material or the like. For example, multilayer electronic components each having element conductors for forming the electronic elements and connecting conductors for forming the lead electrodes which have different attributes can efficiently be manufactured. The attributes of the conductors means the characteristic and the properties of the conductors, for example, the material, hardness, composition and the thermal shrinkage or the like.

As this invention may be embodied in several forms without departing from the spirit of essential characteristics thereof, the present embodiments are therefore illustrative and not restrictive. It is understood that the present disclosure of the preferred form can be changed in the details of construction and in the combination and arrangement of parts without departing from the spirit and the scope of the invention as hereinafter claimed.

What is claimed is:

1. A multilayer electronic component comprising:

a laminated body including (a) a stack of plural insulating sheets having an inner conductor, and (b) a terminal electrode at both ends of said laminated body, said inner conductor including a coil formed of plural coil conductors and a separate lead conductor connecting said coil and each of said terminal electrodes, said insulating sheets including plural first insulating sheets carrying said coil conductor and plural second insulating sheets carrying said lead conductor, all of said second insulating sheets being thicker than any of said first insulating sheets, a plurality of the second sheets being stacked between a first insulating sheet of the plural first sheets and a first of said terminal electrodes, a plurality of the second sheets being stacked between a second insulating sheet of the plural second sheets and a second of said terminal electrodes, the sheets being stacked so the direction of lamination thereof is parallel with the direction of planes occupied by both of said terminal electrodes.

2. The component of claim 1, wherein said coil conductors are connected together by first via holes, and said lead conductors are connected together by second via holes.

3. The component of claim 2, wherein at least one of said second via holes has a larger diameter than the diameters of said first via holes.

4. The component of claim 3, wherein said diameter of said at least one second via hole is at least 100 $\mu$m.

5. The component of claim 2, wherein at least one of said second via holes has a diameter at least twice the diameter of said first via holes.

6. The component of claim 2, wherein said second via holes near said terminal electrode have diameters greater than the diameters of said second via holes near said coil conductor.

7. The component of claim 1, wherein said lead electrode is branched from said coil to said terminal electrode.

8. The component of claim 1 wherein the coil is arranged so the direction of magnetic flux through the coil is parallel with the direction of the planes occupied by both of said terminal electrodes.

9. A method of manufacturing a multilayer electronic component including a laminated body with a coil and a lead electrode embedded therein; and terminal electrodes formed at opposite ends of said laminated body and connected to said coil through said lead electrode, the method comprising the steps of:

(a) forming a coil conductor forming said coil on each of plural first insulating sheets;

(b) forming a lead conductor forming said lead electrode on a plurality of second insulating sheets, each of which is thicker than any of said first insulating sheet;

(c) laminating a plurality of said first insulating sheets to form a first partial sheet laminate;

(d) laminating a plurality of said second insulating sheets to form a second partial sheet laminate;

(e) staking said first partial sheet laminate and second partial laminate to form a sheet laminate so that a plurality of the second insulating sheets are stacked on end faces of the first insulating sheets at opposite ends of the first partial sheet laminate;

(f) cutting said sheet laminate to form said laminated body; and (g) forming said terminal electrodes on said laminated body so that a first set of a plurality of the second insulating sheets is between a first of the terminal electrodes and a first of said end faces, and a second set of a plurality of the second insulating sheets is between a second of the terminal electrodes and a second of said end faces, so there is electrical and physical contact between the lead electrodes and the terminal electrodes.

10. A multilayer electronic component comprising a laminated body including (a) a stack of plural laminated insulating sheets at least some of which carry a first conductor on a face of the sheet, and (b) a terminal electrode on at least one end face of the body;

a plurality of said plural laminated insulating sheets carrying a second conductor, the second conductor connecting the first conductor on the face of one of the sheets to said terminal electrode;

said sheets carrying the second conductor being stacked on each other and all having a thickness greater than any of the sheets carrying the first conductor; and the plural laminated insulating sheets being arranged so the direction of lamination thereof is parallel to the end face of the body.

11. A method of manufacturing a multilayer electronic component including a laminated body with a coil and a lead electrode embedded therein; and a terminal electrode formed at an end of said laminated body and connected to said coil through said lead electrode, the method comprising the steps of:

forming a laminated body including a stack of plural first insulating laminated sheets and plural second laminated insulating sheets, all of which are thicker than any of the first sheets, the first laminated sheets having faces carrying first conductors forming the coil, the second laminated sheets carrying second conductors between faces of the second laminated sheets, the second conductors forming the embedded lead electrode, the laminated body being formed so the faces are perpendicular to the direction of stacking and a plurality of the second sheets are stacked on a face of one of the first sheets, and forming said terminal electrodes on said laminated body so there is electrical and physical contact between the lead electrode and the terminal electrode.

* * * * *